US006788003B2

(12) United States Patent
Inukai et al.

(10) Patent No.: US 6,788,003 B2
(45) Date of Patent: Sep. 7, 2004

(54) LIGHT EMITTING DEVICE

(75) Inventors: Kazutaka Inukai, Kanagawa (JP); Tomoyuki Iwabuchi, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 73 days.

(21) Appl. No.: 10/060,709

(22) Filed: Jan. 29, 2002

(65) Prior Publication Data

US 2002/0125831 A1 Sep. 12, 2002

(30) Foreign Application Priority Data

Jan. 29, 2001 (JP) ..... 2001-019651

(51) Int. Cl.[7] ..... G09G 3/10; G09G 5/00

(52) U.S. Cl. ..... 315/169.3; 345/211

(58) Field of Search ..... 315/169.1, 169.3, 315/169.4; 345/76, 82, 84, 88, 90, 93, 23

(56) References Cited

U.S. PATENT DOCUMENTS

| | | | | |
|---|---|---|---|---|
| 6,239,788 | B1 * | 5/2001 | Nohno et al. | 345/173 |
| 6,310,759 | B2 * | 10/2001 | Ishigaki et al. | 361/309 |
| 6,414,443 | B2 | 7/2002 | Tsuruoka et al. | 315/169.3 |
| 6,424,326 | B2 * | 7/2002 | Yamazaki et al. | 345/77 |
| 6,518,962 | B2 * | 2/2003 | Kimura et al. | 345/211 |
| 2001/0013758 | A1 | 8/2001 | Tsuruoka et al. | 315/169.3 |

FOREIGN PATENT DOCUMENTS

| | | |
|---|---|---|
| EP | 0 905 673 | 3/1999 |
| EP | 0 923 067 | 6/1999 |
| GB | 2 106 299 | 4/1983 |
| JP | 2001-223074 | 8/2001 |

OTHER PUBLICATIONS

Tsutsui, et al., "Electroluminescence in Organic Thin Films", Photochemical Processes in Organized Molecular Systems, 1991, pp. 437–450 (Elsevier Science Publishers, Tokyo, 1991).

Baldo, et al., "Highly efficient phophorescent emission from organic electroluminescent devices", Nature, vol. 395, Sep. 10, 1998, pp. 151–154.

Baldo, et al., "Very high–efficiency green organic light–emitting devices based on electrophosphorescence", Applied Physics Letters, vol. 75, No. 1, Jul. 5, 1999, pp. 4–6.

Tsutsui, et al., "High Quantum Efficiency in Organic Light–Emitting Devices with Iridium–Complex as a Triplet Emissive Center", Japanese Journal of Applied Physics., vol. 38, Part 2, No. 12B, Dec. 15, 1999, pp. L1502–L1504.

* cited by examiner

*Primary Examiner*—Wilson Lee
*Assistant Examiner*—Mind Dien A
(74) *Attorney, Agent, or Firm*—Fish & Richardson PC

(57) ABSTRACT

A light emitting device is provided, in which a change of luminance of an OLED is suppressed and a desired color display can be stably performed even if an organic light emitting layer is somewhat deteriorated or an environmental temperature is varied. Separately from a pixel portion for displaying an image, a pixel portion for measuring a driving current of the OLED is provided in the light emitting device. The driving current is measured in the pixel portion for measuring the driving current of the OLED, and a value of the voltage supplied to the above two pixel portions from a variable power supply is corrected such that the measured driving current has a reference value. With the above-described structure, a reduction of the luminance accompanied with the deterioration of the organic light emitting layer can be suppressed. As a result, a clear image can be displayed.

25 Claims, 18 Drawing Sheets

LIGHT EMITTING DEVICE

BACKGROUND OF THE INVENTION

1. Field of the Invention

The present invention relates to an OLED panel in which an organic light emitting device (OLED) formed on a substrate is enclosed between the substrate and a cover member. Also, the present invention relates to an OLED module in which an IC is mounted on the OLED panel. Note that, in this specification, the OLED panel and the OLED module are generically called light emitting devices. The present invention further relates to an electronic device using the light emitting device.

2. Description of the Related Art

An OLED emits light by itself, and thus, has high visibility. The OLED does not need a backlight necessary for a liquid crystal display device (LCD), which is suitable for a reduction of a light emitting device in thickness. Also, the OLED has no limitation on a viewing angle. Therefore, the light emitting device using the OLED has recently been attracting attention as a display device that substitutes for a CRT or the LCD.

The OLED includes a layer containing an organic compound in which luminescence generated by application of an electric field (electroluminescence) is obtained (organic light emitting material) (hereinafter, referred to as organic light emitting layer), an anode layer and a cathode layer. A light emission in returning to a base state from a singlet excitation state (fluorescence) and a light emission in returning to a base state from a triplet excitation state (phosphorescence) exist as the luminescence in the organic compound. The light emitting device of the present invention may use one or both of the above-described light emissions.

Note that, in this specification, all the layers provided between an anode and a cathode of the OLED are defined as the organic light emitting layers. The organic light emitting layers specifically include a light emitting layer, a hole injecting layer, an electron injecting layer, a hole transporting layer, an electron transporting layer and the like. The OLED basically has a structure in which an anode/a light emitting layer/a cathode are laminated in order. Besides this structure, the OLED may take a structure in which an anode/a hole injecting layer/a light emitting layer/a cathode are laminated in order or a structure in which an anode/a hole injecting layer/a light emitting layer/an electron transporting layer/a cathode are laminated in order.

In putting a light emitting device to practical use, a serious problem at present is a reduction in the luminance of the OLED, which is accompanied with deterioration of the organic light emitting material contained in the organic light emitting layer.

The organic light emitting material in the organic light emitting layer is easily affected by moisture, oxygen, light and heat, and the deterioration of the organic light emitting material is promoted by these substances. Specifically, speed of the deterioration of the organic light emitting layer is influenced by a structure of a device for driving the light emitting device, a characteristic of the organic light emitting material constituting the organic light emitting layer, a material for an electrode, conditions in a manufacturing process, a method of driving the light emitting device, and the like.

Even when a constant voltage is applied to the organic light emitting layer from a pair of electrodes, the luminance of the OLED is lowered due to the deterioration of the organic light emitting layer. Then, if the luminance of the OLED is lowered, an image displayed on the light emitting device becomes unclear. Note that, in this specification, a voltage applied to the organic light emitting layer from one pair of electrodes is defined as an OLED driving voltage (Vel).

Further, in a color display mode in which three kinds of OLEDs corresponding to R (red), G (green) and B (blue) are used, the organic light emitting material constituting the organic light emitting layer differs depending on the corresponding color of the OLED. If the organic light emitting layers of the OLEDs deteriorate at different speeds in accordance with the corresponding colors, the luminance of the OLED differs depending on the color with the lapse of time. Thus, an image having a desired color can not be displayed on the light emitting device.

Furthermore, the luminance of the OLED has large temperature depending property, and thus, there has been a problem in that luminance of a display and a tone vary in accordance with the temperature in constant voltage drive.

SUMMARY OF THE INVENTION

The present invention has been made in view of the above, and an object of the present invention is therefore to provide a light emitting device in which a change of luminance of an OLED is suppressed and a desired color display can be stably performed even when an organic light emitting layer is somewhat deteriorated or when an environmental temperature is varied.

Between a light emission with a constant OLED driving voltage and a light emission with a constant current flowing through the OLED, the present inventor directs an attention to the fact that a reduction of the luminance of the OLED due to deterioration is smaller in the latter. Note that the current flowing through the OLED is called an OLED driving current (Iel) in this specification.

FIG. 2 shows a change of the luminance of the OLED between a case where the OLED driving voltage is constant and a case where the OLED driving current is constant. As shown in FIG. 2, the change of the luminance due to deterioration is smaller in the OLED with the constant OLED driving current. This is because not only an inclination of a straight line L-I becomes small but also a curve I-V itself moves to the lower side when the OLED is deteriorated (see FIGS. 15A and 15B).

Thus, the present inventor devised a light emitting device with a simple structure in which an OLED driving voltage can be corrected such that an OLED driving current is always kept constant even if the OLED driving current is varied due to deterioration or the like.

Specifically, in the present invention, a pixel portion for measuring the OLED driving current is provided in the light emitting device besides a pixel portion for displaying an image. It is preferable that the monitor pixel portion can display some images in order to be effectively used as a display portion. However, it is not essential that the monitor pixel portion can perform an image display. Hereinafter, in order to clearly distinguish between the above-described two pixel portions, the pixel portion in which an image display is aimed is called the display pixel portion (first pixel portion) and the pixel portion in which the measurement of the OLED driving current is aimed is called the monitor pixel portion (second pixel portion) through this specification.

The display pixel portion and the monitor pixel portion have the same structures of their respective pixels, and can be described with the same circuit diagrams. With regard to OLEDs of a pixel of the display pixel portion (hereinafter referred to as display pixel or first pixel) and a pixel of the monitor pixel portion (hereinafter referred to as monitor pixel or second pixel), the OLED driving voltages at the time when the luminance is maximum are controlled by a variable power supply, and both the voltages are preferably kept to have equivalent values.

Note that the variable power supply indicates a power supply in which a voltage supplied to a circuit or an element is not constant but variable in this specification.

Further, the light emitting device of the present invention includes a first means for measuring the OLED driving current of the OLED of the monitor pixel portion (hereinafter referred to as monitor OLED or second OLED), a second means for calculating a voltage applied to the OLED based on the measured value, and a third means for actually controlling the voltage value.

Note that the second means may be a means for comparing the current measured value and a reference value, and the third means may be a means for controlling the variable power supply to shorten a difference between the measured value and the reference value and correcting the OLED driving voltages of the OLED of the display pixel (hereinafter referred to as display OLED or first OLED) and the monitor OLED in the case where the difference exists.

The monitor pixel portion is input with a video signal of a different system from that of a video signal to be input to the display pixel portion. However, both the video signals are the same in the point that the signals each include gradation information, and only the system of an image to be displayed differs between the signals. Hereinafter, the video signal to be input to the display pixel portion is referred to as the display video signal and the video signal to be input to the monitor pixel portion is referred to as the monitor video signal.

When the OLED driving current of the monitor OLED is measured, an image for monitor (hereinafter referred to as monitor image) is displayed on the monitor pixel portion in accordance with the monitor video signal. The monitor image may be either a static image or a dynamic image. Further, the same gradation may be displayed on all the pixels. Moreover, it is preferable that the monitor image in which an average value in time is substantially the same between the OLED drive currents of the display OLED and the monitor OLED is displayed such that the degree of deterioration becomes the same between the display OLED and the monitor OLED.

Note that the reference value of the current does not need to be fixed at the same value at all times. A plurality of monitor images with different reference current values are prepared, and the monitor image may be selected every monitor. Of course, several kinds of monitor images with the same reference current value may be prepared.

With the above-described structure, in the light emitting device of the present invention, the reduction of the luminance of the OLED can be suppressed even with the deterioration of the organic light emitting layer. As a result, a clear image can be displayed.

Further, in the color display mode in which three kinds of OLEDs corresponding to R (red), G (green) and B (blue) are used, monitor pixel portions corresponding to the respective colors may be provided, and the OLED driving current may be measured for every OLED of each color to thereby correct the OLED driving voltage. With this structure, the balance of luminance among the respective colors is prevented from being lost, and a desired color can be displayed even when the organic light emitting layers of the OLEDs deteriorate at different speeds in accordance with the corresponding colors.

Further, a temperature of the organic light emitting layer is influenced by an outer temperature, heat generated by the OLED panel itself, or the like. Generally, when the OLED is driven at a constant voltage, the value of the flowing current changes in accordance with the temperature. FIG. 3 shows a change of a voltage-current characteristic of the OLED when the temperature of the organic light emitting layer is changed. When the voltage is constant, if the temperature of the organic light emitting layer becomes higher, the OLED driving current becomes larger. Since the relationship between the OLED driving current and the luminance of the OLED is substantially proportional, the luminance of the OLED becomes higher as the OLED driving current becomes larger. In FIG. 2, the constant voltage luminance shows a vertical period for about 24 hours. This is because a temperature difference between day and night is reflected. However, in the light emitting device of the present invention, the OLED driving current can always be kept constant by the correction of the OLED driving voltage even if the temperature of the organic light emitting layer is changed. Therefore, a constant luminance can be obtained without being influenced by the temperature change, and also, the increase in power consumption with the temperature rise can be prevented.

Moreover, a degree of the change of the OLED driving current in the temperature change generally differs depending on the kind of the organic light emitting material. Thus, in the color display, the luminances of the OLEDs of the respective colors may be separately changed in accordance with the temperature. However, in the light emitting device of the present invention, the constant luminance can be obtained without being influenced by the temperature change. Thus, the balance of luminance among the respective colors is prevented from being lost, and a desired color can be displayed.

Incidentally, the present invention is particularly effective for an active matrix light emitting device of digital time gradation drive, and is also effective for an active matrix light emitting device of analogue gradation drive. Further, the present invention can be applied to a passive light emitting device.

Furthermore, the monitor pixel portion can be effectively used in a display of icons, logos, patterns, indicators and the like, and this can eliminate waste. In addition, the monitor takes the same type as the pixel, whereby the deterioration of the pixel OLED can be caught with higher definition. Thus, the luminance correction can be performed with ease and with accuracy.

BRIEF DESCRIPTION OF THE DRAWINGS

In the accompanying drawings:

FIGS. 15A and 18B show changes of a voltage-current characteristic and a current-luminance characteristic of an OLED due to deterioration.

DETAILED DESCRIPTION OF THE PREFERRED EMBODIMENTS

Hereinafter, the structure of the present invention will be described.

Figure 1:
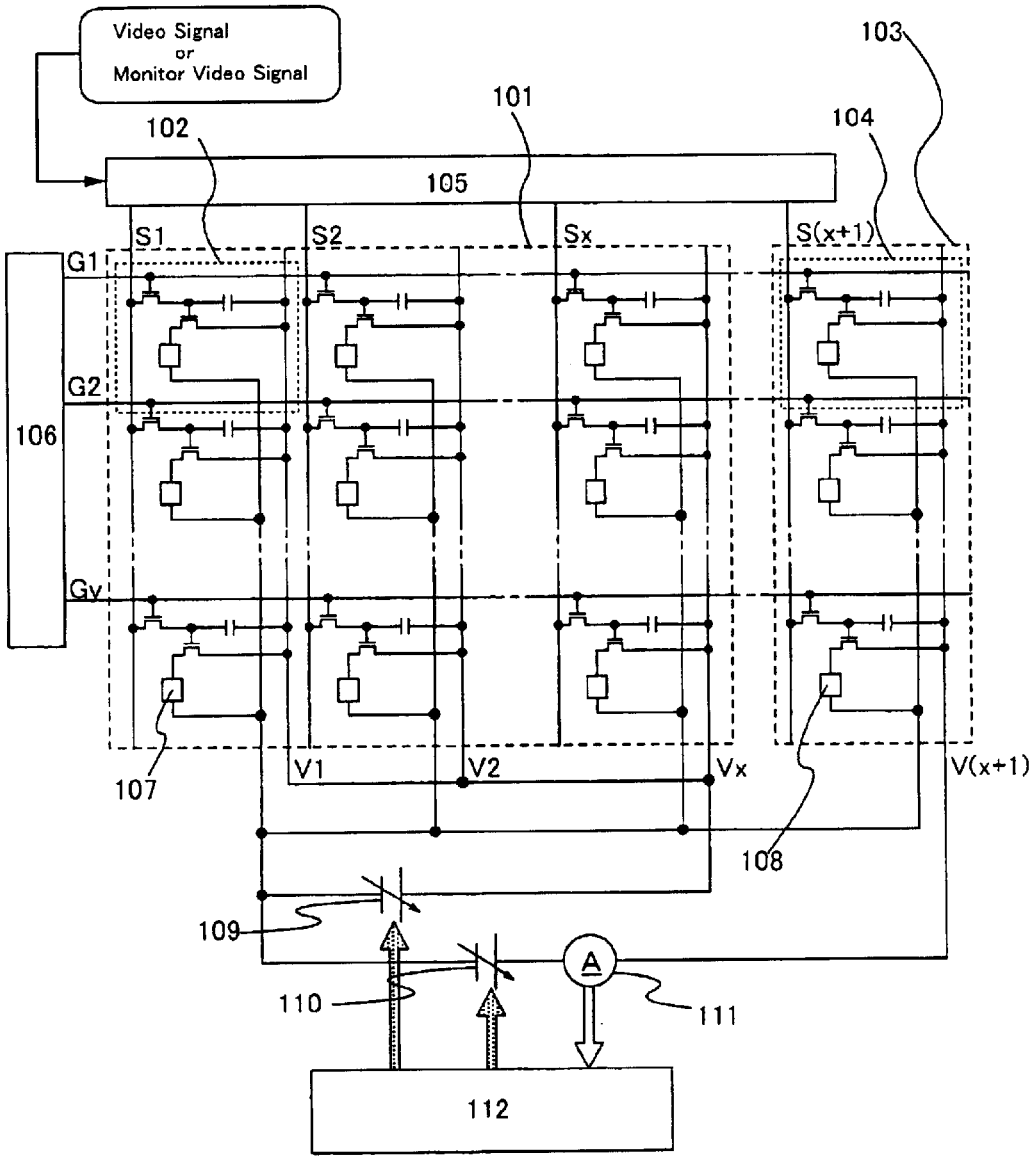
FIG. 1 is a block diagram of a light emitting device of the present invention.

FIG. 1 is a block diagram of the structure of an OLED panel of the present invention. Reference numeral 101 denotes a display pixel portion in which a plurality of display pixels 102 are formed in matrix. Reference numeral 103 denotes a monitor pixel portion in which a plurality of monitor pixels 104 are formed in matrix. Further, reference numerals 105 and 106 denote a source line driver circuit and a gate line driver circuit, respectively.

The display pixel portion 101 and the monitor pixel portion 103 may be formed on the same substrate or formed on different substrates. Note that, although the source line driver circuit 105 and the gate line driver circuit 106 are formed on the substrate on which the display pixel portion 101 and the monitor pixel portion 103 are formed in FIG. 1, the present invention is not limited to this structure. The source line driver circuit 105 and the gate line driver circuit 106 may be formed on the substrate different from the substrate on which the pixel portion 101 or the monitor pixel portion 103 is formed, and may be connected to the pixel portion 101 or the monitor pixel portion 103 through a connector such as an FPC. Further, one source line driver circuit 105 and one gate line driver circuit 106 are provided in FIG. 1, but the present invention is not limited to this structure. The number of source line driver circuits 105 and the number of gate line driver circuits 106 may be arbitrarily set by a designer.

Further, in FIG. 1, source lines S1 to Sx, power supply lines V1 to Vx and gate lines G1 to Gy are provided in the display pixel portion 101. Then, a source line S(x+1), a power supply line V(x+1) and the gate lines G1 to Gy are provided in the monitor pixel portion 103. The number of source lines and the number of power supply lines are not always the same. Further, in addition to these lines, different lines may be provided. Also in FIG. 1, an example in which only pixels of one line having the source line S(x+1) are provided in the monitor pixel portion 103 is shown. However, the light emitting device of the present invention is not limited to this structure. Pixels of plural lines having a plurality of source lines may be provided in the monitor pixel portion 103. The number of pixels provided in the monitor pixel portion 103 can be appropriately selected by a designer.

Display OLEDs 107 are provided in the respective display pixels 102. Further, monitor OLEDs 108 are provided in the respective monitor pixels 104. The display OLED 107 and the monitor OLED 108 each have an anode and a cathode. In this specification, in the case where the anode is used as a pixel electrode (first electrode), the cathode is called an opposing electrode (second electrode) while, in the case where the cathode is used as a pixel electrode, the anode is called an opposing electrode.

The pixel electrode of each of the display OLEDs 107 is connected to one of the power supply lines V1 to Vx through one TFT or a plurality of TFTs. The power supply lines V1 to Vx are all connected to a display variable power supply 109. The opposing electrodes of the display OLEDs 107 are all connected to the display variable power supply 109. Note that the opposing electrodes of the display OLEDs 107 may be connected to the display variable power supply 109 through one element or a plurality of elements.

On the other hand, the pixel electrode of each of the monitor OLEDs 108 is connected to the power supply line V(x+1) through one TFT or a plurality of TFTs. The power supply line V(x+1) is connected to a monitor variable power supply 110 through an ammeter 111. The opposing electrodes of the monitor OLEDs 108 are all connected to the monitor variable power supply 110. Note that the opposing electrodes of the monitor OLEDs 108 may be connected to the monitor variable power supply 110 through one element or a plurality of elements.

Note that, in FIG. 1, the display variable power supply 109 and the monitor variable power supply 110 are connected such that the power supply line side is kept at a high potential (Vdd) while the opposing electrode side is kept at a low potential (Vss). However, the present invention is not limited to this structure, and the display variable power supply 109 and the monitor variable power supply 110 may be connected such that the current flown through the display OLED 107 and the monitor OLED 108 has a forward bias.

Further, a position where the ammeter 111 is provided is not necessarily located between the monitor variable power supply 110 and the power supply lines. The position may be located between the monitor variable power supply 110 and the opposing electrodes.

Reference numeral 112 denotes a correction circuit which controls the display variable power supply 109 and the monitor variable power supply 110 based on a current value (measured value) measured with the ammeter 111. Specifically, the correction circuit 112 controls the voltage supplied to the opposing electrodes of the display OLEDs 107 and the power supply lines V1 to Vx from the display variable power supply 109 and the voltage supplied to the opposing electrodes of the monitor OLEDs 108 and the power supply line V(x+1) from the monitor variable power supply 110.

Incidentally, the ammeter 111, the display variable power supply 109, the monitor variable power supply 110 and the correction circuit 112 may be formed on the substrate different from the substrate on which the display pixel portion 101 and the monitor pixel portion 103 are formed, and may be connected to the display pixel portion 101 and the monitor pixel portion 103 through a connector or the like. If possible, the above-described components may be formed on the same substrate as the display pixel portion 101 and the monitor pixel portion 103.

Further, in a color display mode, a display variable power supply, a monitor variable power supply, a correction circuit and an ammeter may be provided for each color, and an OLED driving voltage may be corrected in the OLED of each color. Note that, at this time, the correction circuit may be provided for each color, or the common correction circuit may be provided for the OLEDs of plural colors.

Figure 4:
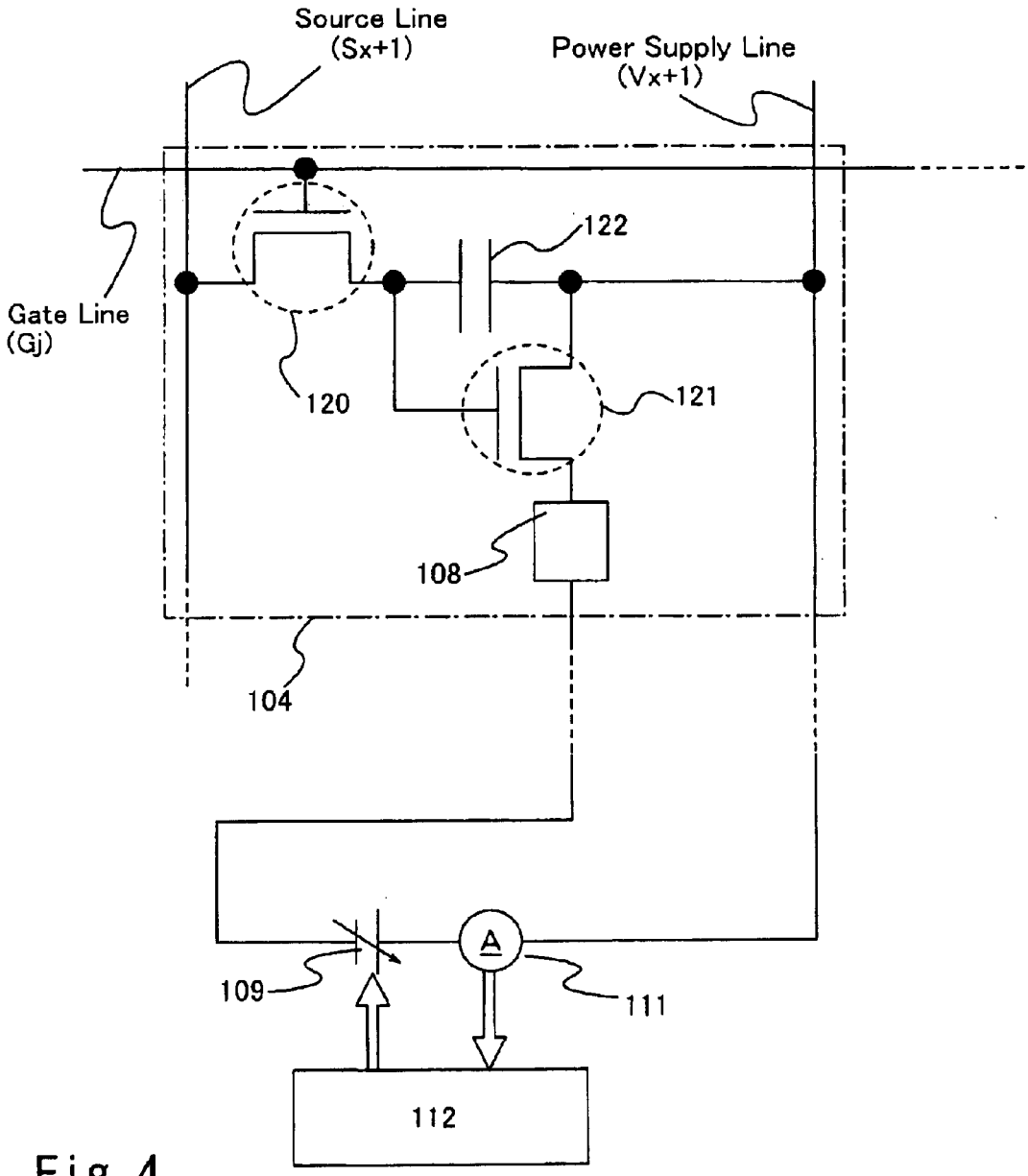
FIG. 4 is a pixel circuit diagram of the light emitting device of the present invention.

FIG. 4 shows the detailed structure of the monitor pixel 104. Note that the display pixel 102 has the same device connection structure as the monitor pixel 104.

The monitor pixel 104 in FIG. 4 has the source line S(x+1), the gate line Gj(j=1 to y), the power supply line V(x+1), a switching TFT 120, a driving TFT 121, a capacitor 122 and the monitor OLED 108. The pixel structure shown in FIG. 4 is just one example, and the number of lines and elements of the pixel, the kind thereof and the connection are not limited to those in the structure shown in FIG. 4. The light emitting device of the present invention may take any structure provided that the OLED driving voltage of the OLED of each pixel can be controlled by the variable power supply.

In FIG. 4, a gate electrode of the switching TFT 120 is connected to the gate line Gj. One of a source region and a drain region of the switching TFT 120 is connected to the source line S(x+1), and the other is connected to a gate electrode of the driving TFT 121. Then, one of a source region and a drain region of the driving TFT 121 is connected to the power supply line V(x+1), and the other is connected to the pixel electrode of the monitor OLED 108. The capacitor 122 is formed between the gate electrode of the driving TFT 121 and the power supply line V(x+1).

In the monitor pixel 104 shown in FIG. 4, the potential of the gate line Gj is controlled by the gate line driver circuit 106, and the source line S(x+1) is input with a monitor video signal by the source line driver circuit 105. When the switching TFT 120 is turned on, the monitor video signal input to the source line S(x+1) is input to the gate electrode of the driving TFT 121 through the switching TFT 120. Then, when the driving TFT 121 is turned on in accordance with the monitor video signal, the OLED driving voltage is applied between the pixel electrode and the opposing electrode of the monitor OLED 108 by the monitor variable power supply 110. Thus, the monitor OLED 108 emits light.

While the monitor OLED 108 is emitting light, a current is measured with the ammeter 111. The measured value as data is sent to the correction circuit 112. The period for the measurement of the current differs depending on a performance of the ammeter 111, and the period needs to have the length equal to or longer than that of the period during which the measurement can be performed. Further, with the ammeter 111, the average value or the maximum value of the current flowing in the measurement period is made to be read.

In the correction circuit 112, the measured value of the current and a set current value (reference value) are compared. Then, in the case where there is some difference between the measured value and the reference value, the correction circuit 112 controls the monitor variable power supply 110 and the display variable power supply 109, and corrects the voltage between the power supply line V(x+1) and the opposing electrode of the monitor OLED 108 and the voltage between the power supply lines V1 to Vx and the opposing electrodes of the display OLEDs 107. Thus, the OLED driving voltages in the display OLED 107 and the monitor OLED 108 are corrected, and an OLED driving current with a desired size flows.

Note that the OLED driving voltage may be corrected by controlling the potential at the power supply line side or may be corrected by controlling the potential at the opposing electrode side. Further, the OLED driving voltage may be corrected by controlling both the potential at the power supply line side and the potential at the opposing electrode side.

Figure 5:
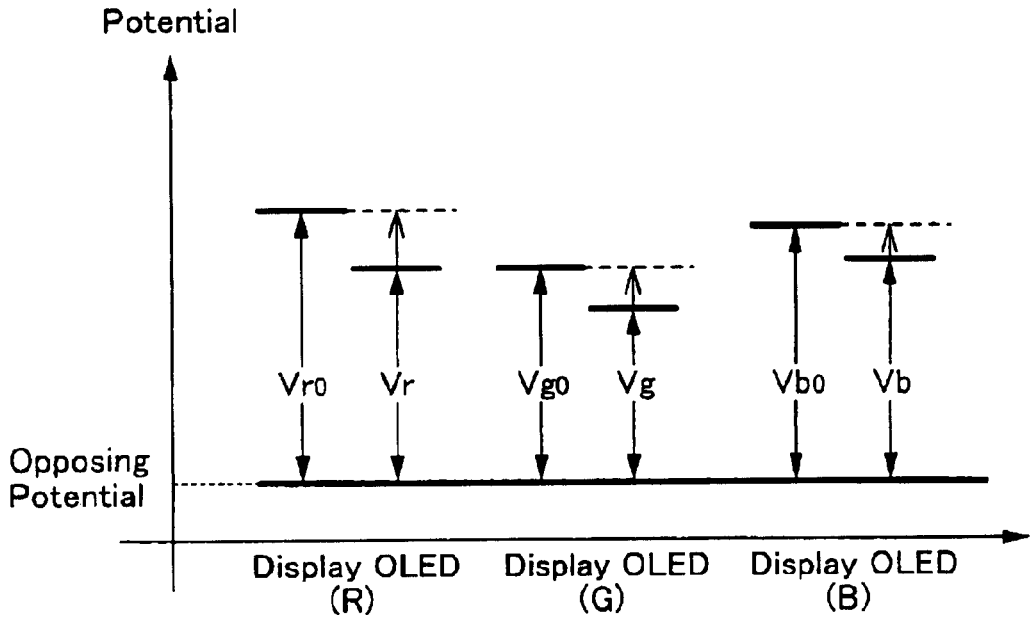
FIG. 5 shows a change of a voltage in accordance with correction.

FIG. 5 shows a change of the OLED driving voltage of the OLED of each color in the case where the potential at the power supply line side is controlled in a color light emitting device. In FIG. 5, Vr indicates the OLED driving voltage before correction in a display OLED (R) for R, and $Vr_o$ indicates the OLED driving voltage after correction. Similarly, Vg indicates the OLED driving voltage before correction in a display OLED (G) for G, and $Vg_o$ indicates the OLED driving voltage after correction. Vb indicates the OLED driving voltage before correction in a display OLED (B) for B, and $Vb_o$ indicates the OLED driving voltage after correction.

In case of FIG. 5, the potentials of the opposing electrodes (opposing potentials) are fixed at the same level in all of the display OLEDs. The OLED driving current is measured for every display OLED of each color, and the potential of the power supply line (power supply potential) is controlled by the display variable power supply, whereby the OLED driving voltage is corrected.

Incidentally, two variable power supplies, that is, the display variable power supply corresponding to the display pixel portion and the monitor variable power supply corresponding to the monitor pixel portion are used in FIG. 1, but the present invention is not limited to this structure. One variable power supply may be substituted for the display variable power supply and the monitor variable power supply.

Figure 2:
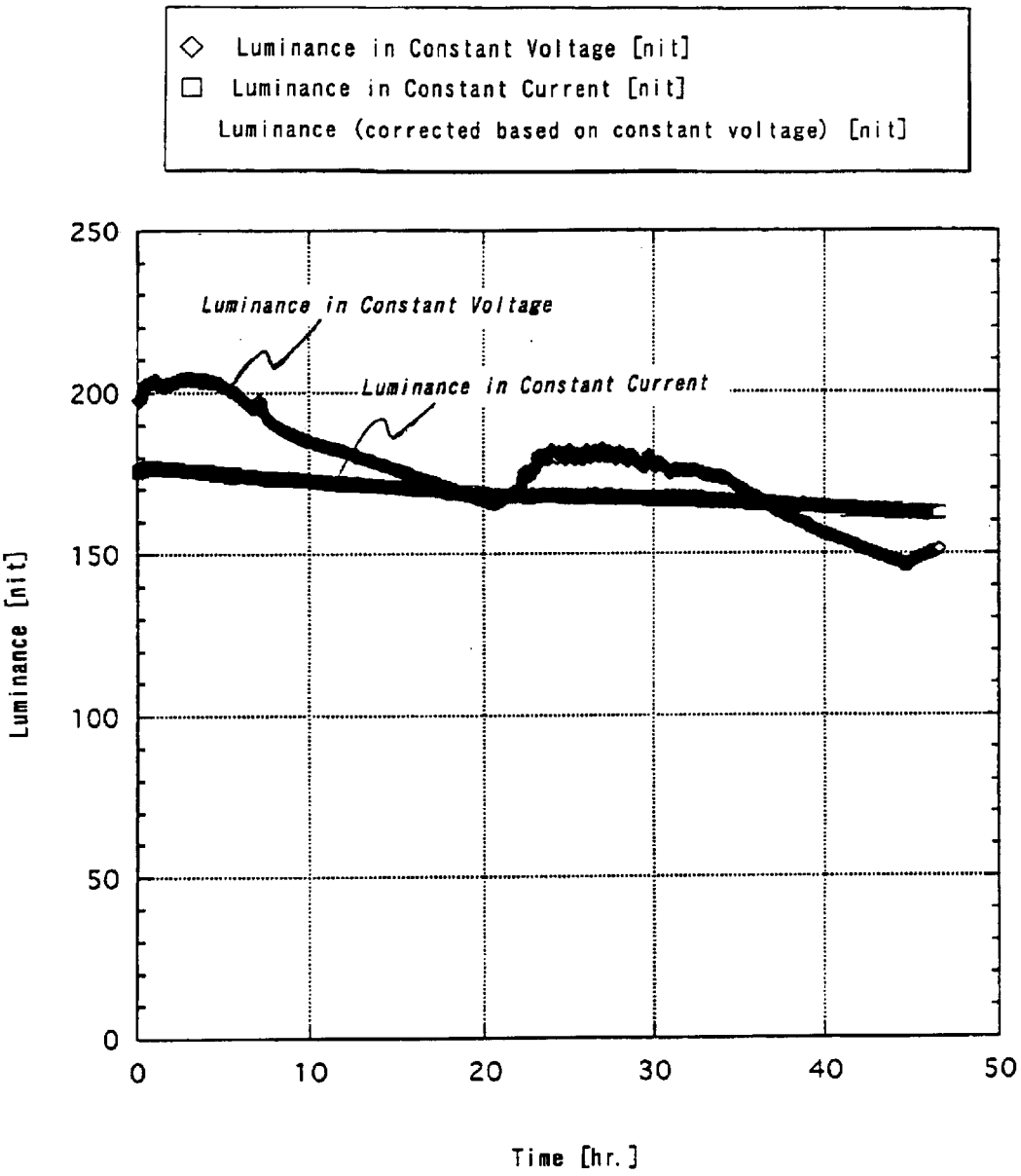
FIG. 2 shows a change of luminance due to deterioration in constant current drive or in constant voltage drive.
Figure 3:
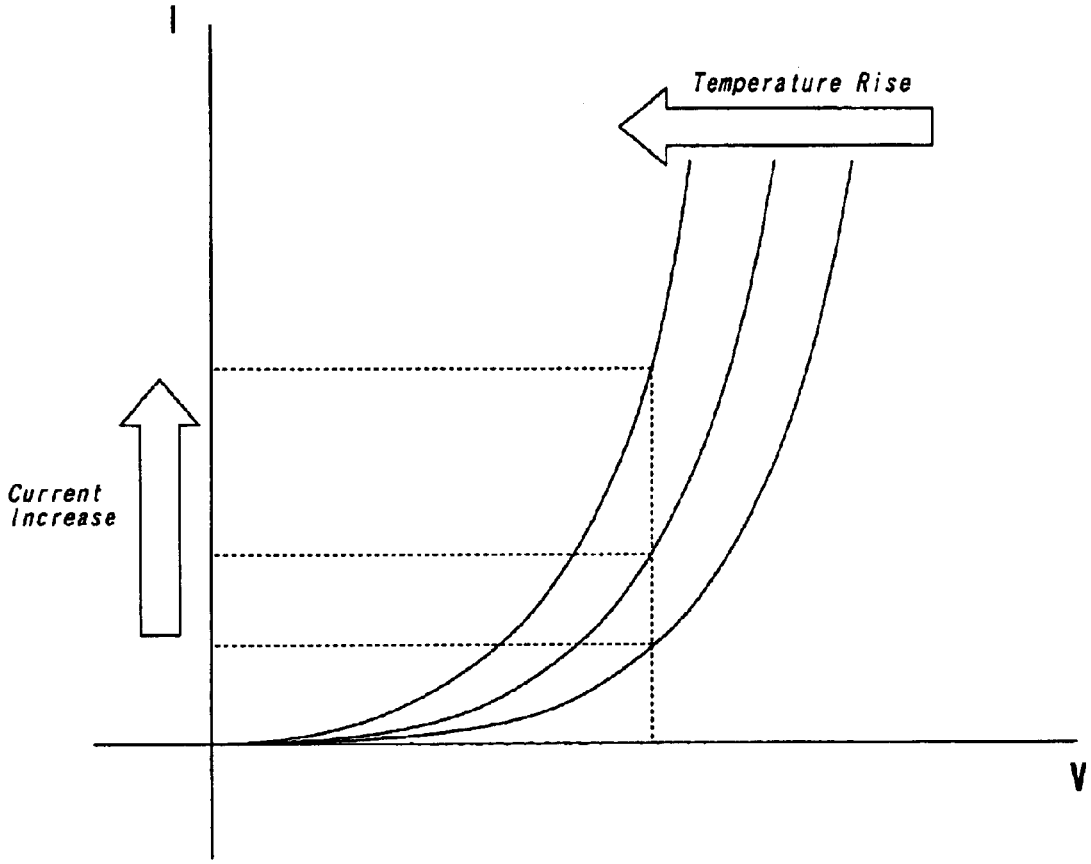
FIG. 3 shows a change of a current in accordance with a temperature of an organic light emitting layer.

In the light emitting device of the present invention, with the above-described structure, there can be obtained the same change of luminance as that obtained when the OLED driving current in FIG. 2 is made constant.

According to the present invention, with the above-described structure, the reduction of the luminance of the OLED can be suppressed even if the organic light emitting layer is deteriorated. As a result, a clear image can be displayed. Further, in case of the light emitting device with the color display in which the OLEDs corresponding to respective colors are used, the balance of luminance among the respective colors is prevented from being lost, and a desired color can be displayed even when the organic light emitting layers of the OLEDs deteriorate at different speeds in accordance with the corresponding colors.

Further, the change of the luminance of the OLED can be suppressed even if the temperature of the organic light emitting layer is influenced by the outer temperature, the heat generated by the OLED panel itself, or the like. Also, the increase in power consumption with the temperature rise can be prevented. Further, in case of the light emitting device with the color display, the change of the luminance of the OLED of each color can be suppressed without being influenced by the temperature change. Thus, the balance of the luminance among the respective colors is prevented from being lost, and a desired color can be displayed.

Embodiments

Hereinafter, embodiments of the present invention will be described.

[Embodiment 1]

In this embodiment, the detailed structure of a correction circuit of a light emitting device of the present invention is described.

Figure 6:
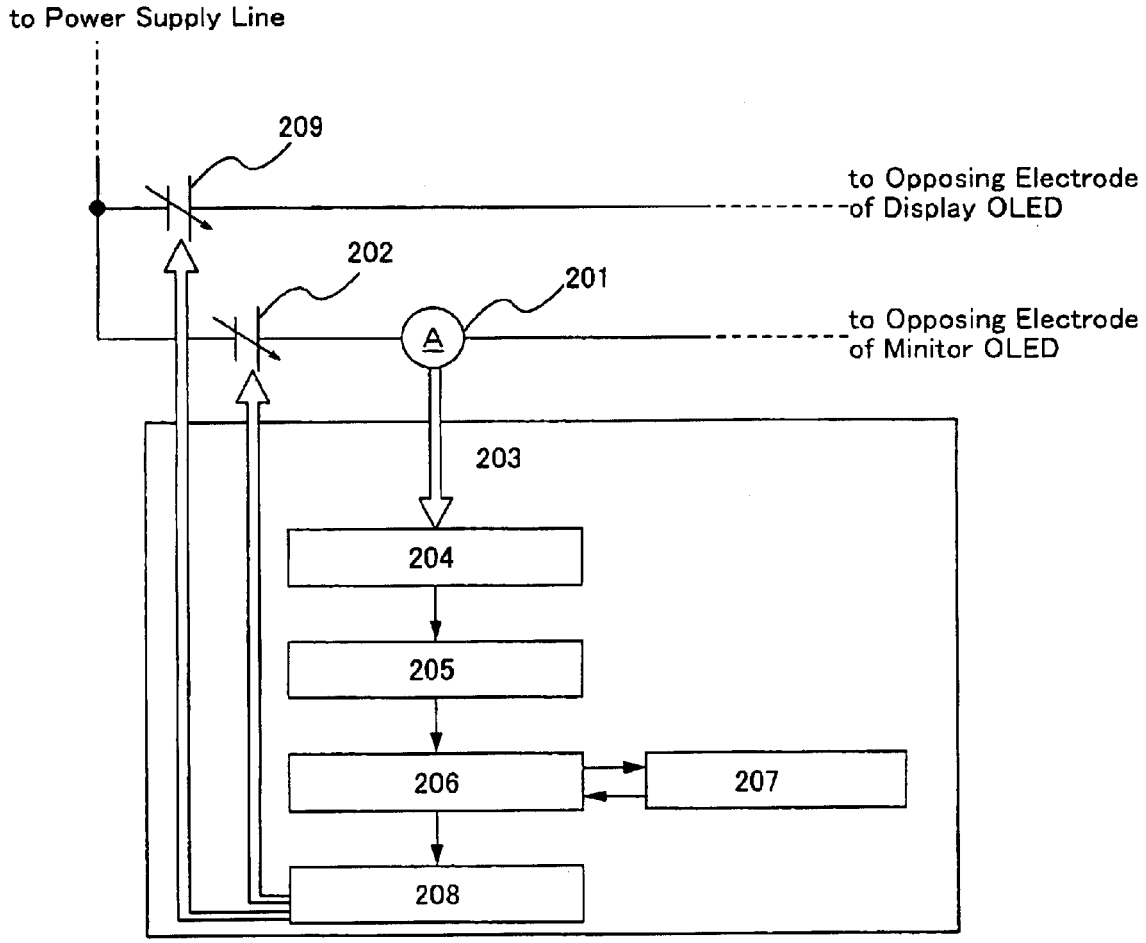
FIG. 6 is a block diagram of a correction circuit.

FIG. 6 is a block diagram of the structure of the correction circuit in this embodiment. A correction circuit 203 includes an A/D converter circuit 204, a memory for measured value 205, a calculation circuit 206, a memory for reference value 207 and a controller 208.

A current value (measured value) measured with an ammeter 201 is input to the A/D converter circuit 204 of the correction circuit 203. In the A/D converter circuit 204, an analogue measured value is converted into a digital one. Digital data of the converted measured value is input to the memory for measured value 205 to be held.

On the other hand, digital data of the reference value of an OLED driving current is held in the memory for reference value 207. In the calculation circuit 206, the digital data of the measured value held in the memory for measured value 205 and the digital data of the reference value held in the memory for reference value 207 are read out to be compared.

Then, in accordance with the comparison between the digital data of the measured value and the digital data of the reference value, a monitor variable power supply 202 and a display variable power supply 209 are controlled in order to make the value of the current actually flowing through the ammeter 201 close to the reference value. More specifically, the monitor variable power supply 202 and the display variable power supply 209 are controlled, whereby the voltage between the power supply lines V1 to Vx and the opposing electrodes of the display OLEDs and the voltage between the power supply line V(x+1) and the opposing electrode of the monitor OLED are corrected. As a result, the OLED driving voltages in the display OLED and the monitor OLED are corrected, and thus, the OLED driving current with a desired size flows.

Figure 7:
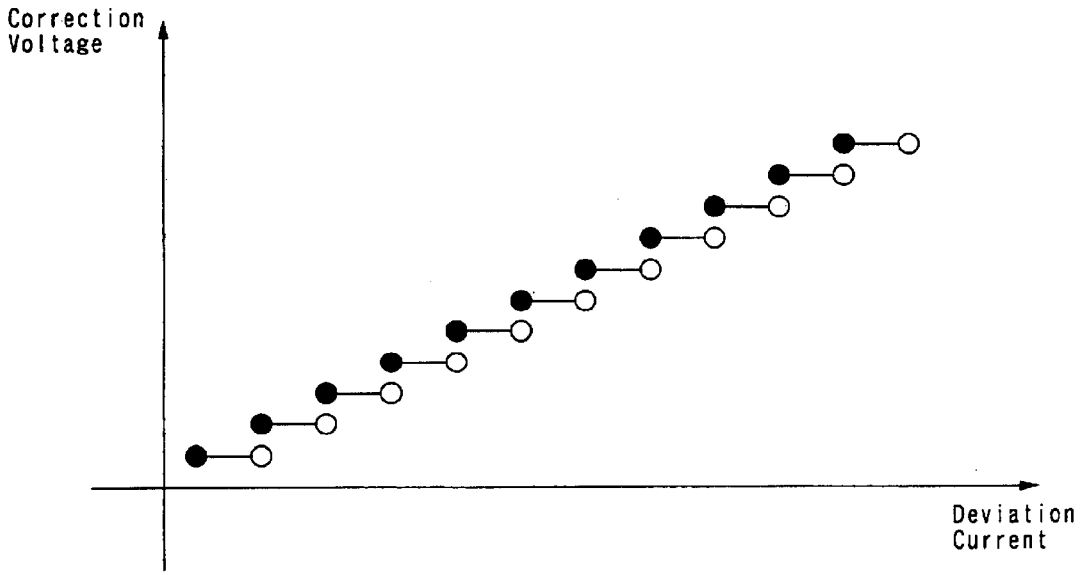
FIG. 7 shows a relationship between a deviation current and a correction voltage.

When it is assumed that the current difference between the measured value and the reference value is a deviation current and that the voltage of the amount for change in accordance with the correction between the power supply lines V1 to Vx and the opposing electrodes is a correction voltage, the relationship between the deviation current and the correction voltage is illustrated in FIG. 7, for example. In FIG. 7, the correction voltage is changed with a constant size every time when the deviation current is changed with a constant width.

Note that the relationship between the deviation current and the correction voltage may not necessarily conform to the graph shown in FIG. 7. It is only necessary that the deviation current and the correction voltage have a relationship such that the value of the current actually flowing through the ammeter becomes close to the reference value. For example, the relationship between the deviation current and the correction voltage may have linearity. Also, the deviation current may be proportional to the second power of the correction voltage.

Note that the structure of the correction circuit shown in this embodiment is just one example, and the present invention is not limited to this structure. It is only necessary that the correction circuit used in the present invention has the means for measuring the measured value and the reference value and the means for performing some calculation processing based on the measured value by means of the ammeter and correcting the OLED driving voltage. The voltage value of the monitor variable power supply and the voltage value of the display variable power supply may not necessarily have the same structure. It may be only necessary that a calculation processing method for the time when the deviation current becomes a value equal to or larger than a certain fixed value is prescribed instead of performing correction using the current reference value stored in the memory.

[Embodiment 2]

In this embodiment the structure of a monitor pixel different from that in FIG. 4 in the light emitting device of the present invention is described.

Figure 8:
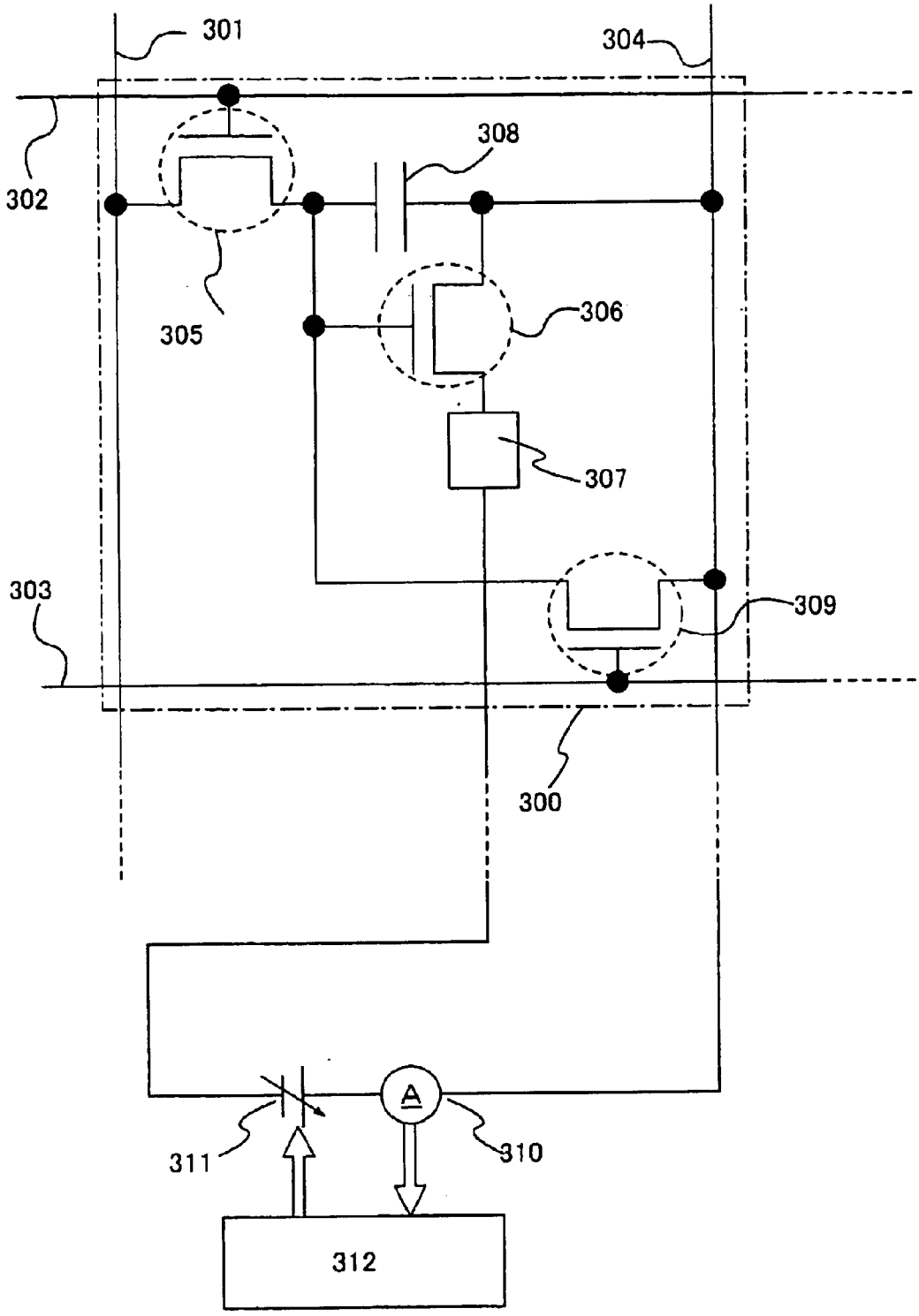
FIG. 8 is a pixel circuit diagram of a light emitting device of the present invention.

FIG. 8 shows the structure of the monitor pixel in this embodiment. In a monitor pixel portion of the light emitting device in this embodiment, monitor pixels 300 are provided in matrix. The monitor pixel 300 has a source line 301, a first gate line 302, a second gate line 303, a power supply line 304, a switching TFT 305, a driving TFT 306, an erasing TFT 309 and a monitor OLED 3)07.

A gate electrode of the switching TFT 305 is connected to the first gate line 302. One of a source region and a drain region of the switching TFT 305 is connected to the source line 301, and the other is connected to a gate electrode of the driving TFT 306.

A gate electrode of the erasing TFT 309 is connected to the second gate line 303. One of a source region and a drain region of the erasing TFT 309 is connected to the power supply line 304, and the other is connected to the gate electrode of the driving TFT 306.

A source region of the driving TFT 306 is connected to the power supply line 304, and a drain region of the driving TFT 306 is connected to a pixel electrode of the monitor OLED 307. A capacitor 308 is formed between the gate electrode of the driving TFT 306 and the power supply line 304.

The power supply line 304 is connected to a monitor variable power supply 311 through an ammeter 310. Further, opposing electrodes of the monitor OLEDs 307 are all connected to the monitor variable power supply 311. Note that, in FIG. 8, the monitor variable power supply 311 is connected such that the power supply line side is kept at a high potential (Vdd) and the opposing electrode side is kept at a low potential side (Vss). However, the present invention is not limited to this structure. It may be only necessary that the monitor variable power supply 311 is connected such that the current flowing through the monitor OLED 307 has a forward bias.

The ammeter 310 does not necessarily provided between the monitor variable power supply 311 and the power supply line 304, and may be provided between the monitor variable power supply 311 and the opposing electrode.

Reference numeral 312 denotes a correction circuit which controls the voltage supplied to the opposing electrode and the power supply line 304 from the monitor variable power supply 311 based on the current value (measured value) measured in the ammeter 310.

Note that the ammeter 310, the monitor variable power supply 311 and the correction circuit 312 may be formed on the substrate different from the substrate on which the monitor pixel portion is formed, and may be connected to the monitor pixel portion through a connector or the like. If possible, the above-described components may be formed on the same substrate as the monitor pixel portion.

Further, in a color display mode, a monitor variable power supply an ammeter and a correction circuit may be provided for each color, and an OLED driving voltage may be corrected in the OLED of each color. Note that, at this time, the correction circuit may be provided for each color, or the common correction circuit may be provided for the OLEDs of plural colors.

In the monitor pixel shown in FIG. 8, the potentials of the first gate line 302 and the second gate line 303 are controlled by different gate line driver circuits. The source line 301 is input with a monitor video signal by a source line driver circuit.

When the switching TFT 305 is turned on, the monitor video signal input to the source line 301 is input to the gate electrode of the driving TFT 306 through the switching TFT 301. Then, when the driving TFT 306 is turned on in accordance with the monitor video signal, the OLED driving voltage is applied between the pixel electrode and the opposing electrode of the monitor OLED 307 by the monitor variable power supply 311. Thus, the monitor OLED 307 emits light.

Then, when the erasing TFT 309 is turned on, the potential difference between the source region and the gate electrode of the driving TFT 306 becomes close to zero, and the driving TFT 306 is turned off. Thus, the monitor OLED 307 does not emit light.

In the present invention, while the monitor OLED 307 is emitting light, a current is measured in the ammeter 310. The measured value as data is sent to the correction circuit 312.

In the correction circuit 312, the measured value of the current and a fixed current value (reference value) are compared. Then, in the case where there is some difference between the measured value and the reference value, the monitor variable power supply 311 is controlled to correct the voltage between the power supply line 304 and the opposing electrode. Thus, the OLED driving voltage is corrected in the monitor OLED 307 of the monitor pixel 300, and an OLED driving current with a desired size flows.

Note that the OLED driving voltage may be corrected by controlling the potential at the power supply line side, or may be corrected by controlling the potential at the opposing electrode side. Also, the OLED driving voltage may be corrected by controlling both the potential at the power supply line side and the potential at the opposing electrode side.

Further, an image for monitor is preferably an image in which as many monitor OLEDs of the pixels as possible emit light in the pixel portion. Even if there is an error in the current value measured with the ammeter, the ratio of the error in the measured current value to the entire measured value becomes smaller as both the measured value and the reference value become larger. In the monitor image, the gradation at the same level as the average of the pixels is made in order to make the progress of deterioration uniform.

Note that, although the structure of the monitor pixel is described in this embodiment, a display pixel also has the same structure. However, in case of the display pixel, the power supply line is not connected to the ammeter, and an opposing electrode of a display OLED is connected to not the monitor variable power supply but a display variable power supply.

The structure of the pixel shown in this embodiment is just one example, and the present invention is not limited to this structure. Note that this embodiment can be implemented by freely being combined with Embodiment 1.

[Embodiment 3]

In this embodiment, a monitor image displayed in the monitor pixel portion in performing correction of a current in the light emitting device of the present invention is described.

In the present invention, the correction of the current may always be conducted, or may be conducted at the time predetermined in advance by setting. A user may arbitrarily conduct the correction of the current.

The display pixel portion and the monitor pixel portion are separately provided in the light emitting device of the present invention. Thus, a display is not restricted.

A reference value of the current at the time when the monitor image is displayed is stored in the correction circuit. Thus, the correction can be performed without obstruction to and influence on the image display on a screen.

Further, monitor images having different reference current values may be used. In this case, a video signal is also input to the correction circuit, and the reference value is calculated in a calculation circuit or the like. In the case where the monitor image is not used, it is not necessary that a monitor video signal is used, and of course, the image to be displayed is not changed against intention of a user.

The monitor image during a current monitor is made to satisfy the following condition.

$$\sum_{k=0}^{n} k \cdot m_k = const. \qquad \text{(Formula 1)}$$

In Formula 1, symbol n indicates the total number of gradations of a video signal. Symbol k indicates the number of gradations, and takes a value of 0 to n. Symbol $m_k$ indicates the number of pixels with the number of gradations of k in the monitor pixel portion. Note that, in case of the light emitting device with the color display. Formula 1 is applied to every pixels corresponding to each color.

This embodiment can be implemented by being freely combined with Embodiment 1 or 2.

[Embodiment 4]

Figure 9:
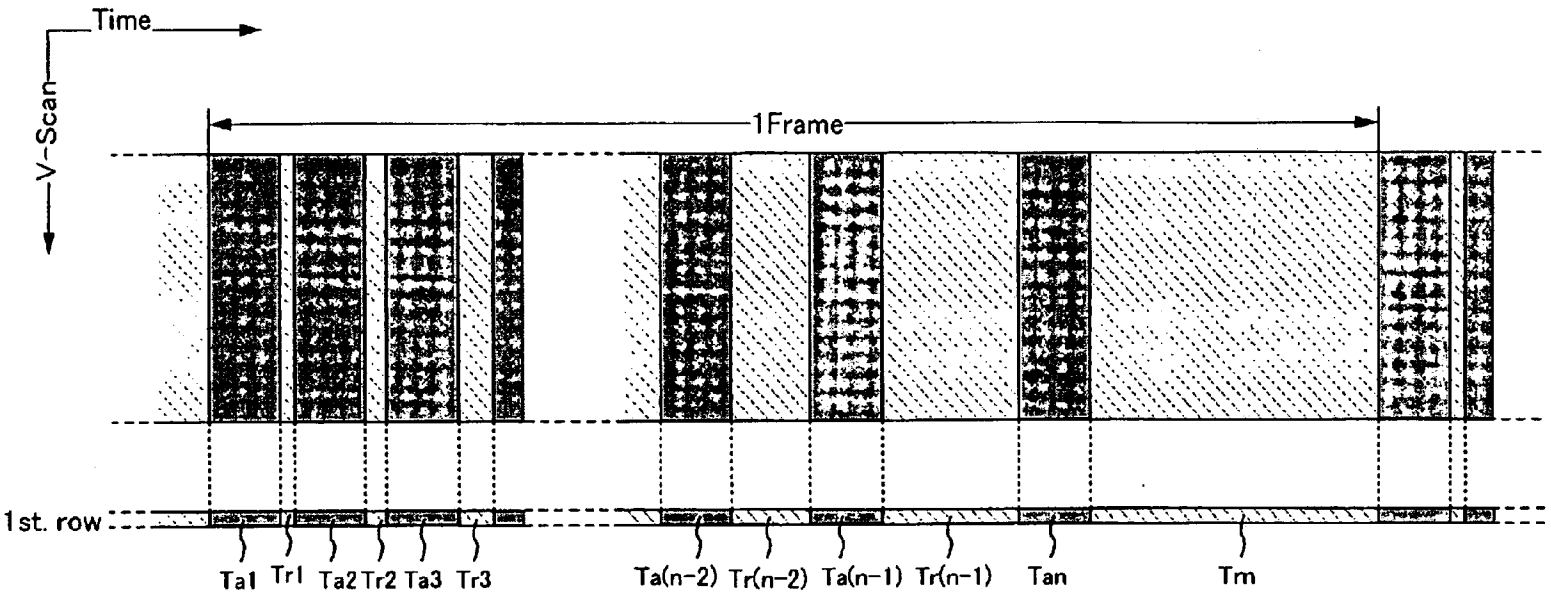
FIG. 9 is a diagram showing a method of driving the light emitting device of the present invention.

In this embodiment, a driving method of the light emitting device of the present invention in FIG. 1 and FIG. 4 is described with reference to FIG. 9. Note that, in FIG. 9, a horizontal axis indicates time and a vertical axis indicates the position of a display pixel connected to a gate line. In this embodiment, a driving method of the display pixel portion is described. However, a display of the monitor pixel portion can be performed by using the same driving method.

First, when a writing period Ta is started, the power supply potential of the power supply lines V1 to Vx is kept at the same level as the potential of the opposing electrode of the display OLED 107. Then, the switching TFT 120 of each of all the display pixels connected to the gate line G1 (display pixels of the first line) is turned on in accordance with a selection signal output from the gate line driver circuit 106.

Then, a video signal of digital (hereinafter referred to as digital video signal) of the first bit input to each of the source lines (S1 to Sx) by the source line driver circuit 105 is input to the gate electrode of the driving TFT 121 through the switching TFT 120.

Next, the switching TFT 120 of each display pixel of the first line is turned off. Similarly to the display pixels of the first line, the switching TFT 120 of each of the display pixels of the second line which are connected to the gate line G2 is turned on by the selection signal. Next, the digital video signal of the first bit from each of the source lines (S1 to Sx) is input to the gate electrode of the driving TFT 121 through the switching TFT 120 of each display pixel of the second line.

Then, the digital video signals of the first bit are input to the display pixels of all the lines in order. The period during which the digital video signals of the first bit are input to the display pixels of all the lines is a writing period Ta1. Note that, in this embodiment, that the digital video signal is input to the pixel means that the digital video signal is input to the gate electrode of the driving TFT 121 through the switching TFT 120.

The writing period Ta1 is completed, and then, a display period Tr1 is started. In the display period Tr1, the power supply potential of the power supply line becomes the potential having a potential difference with the opposing electrode with an extent such that the OLED emits light when the power supply potential is given to the pixel electrode of the OLED.

In this embodiment, in the case where the digital video signal has information of "0", the driving TFT 121 is in an off state. Thus, the power supply potential is not given to the pixel electrode of the display OLED 107. As a result, the display OLED 107 of the display pixel input with the digital video signal having the information of "0" does not emit light.

On the contrary, in the case where the digital video signal has information of "1", the driving TFT 121 is in an on state. Thus, the power supply potential is given to the pixel electrode of the display OLED 107. As a result, the display OLED 107 of the display pixel input with the digital video signal having the information of "1" emits light.

As described above, the display OLED 107 is in an emission state or a non-emission state in the display period Tr1, and all the display pixels perform the display. The period during which the display pixels perform the display is called a display period Tr. Particularly, the display period which starts by the digital video signals of the first bit being input to the display pixels is called the display period Tr1.

The display period Tr1 is completed, and then, a writing period Ta2 is started. The power supply potential of the power supply line again becomes the potential of the opposing electrode of the OLED. Similarly to the case of the writing period Ta1, all the gate lines are selected in order, and the digital video signals of the second bit are input to all the display pixels. The period during which the digital video signals of the second bit are input to the display pixels of all the lines is called the writing period Ta2.

The writing period Ta2 is completed, and then, a display period Tr2 is started. The power supply potential of the power supply line becomes the potential having the potential difference with the opposing electrode with an extent such that the OLED emits light when the power supply potential is given to the pixel electrode of the OLED. Then, all the display pixels perform the display.

The above-described operation is repeatedly performed until the digital video signals of n-th bit are input to the display pixels, and the writing period Ta and the display period Tr alternately appears. When all the display periods (Tr1 to Trn) are completed, one image can be displayed. In this specification, a period for displaying one image is called one frame period (F). The one frame period is completed, and then, the next frame period is started. Then, the writing period Ta1 appears again, and the above-described operation is repeated.

In the general light emitting device, it is preferable that 60 or more frame periods are provided for one second. If the number of images displayed for one second is less than 60, a flicker of an image may become visually conspicuous.

In this embodiment, it is necessary that the sum of lengths of all the writing periods is shorter than the one frame period, and also that the ratio of the lengths of the display periods is Tr1:Tr2:Tr3: . . . :Tr(n−1):Trn=$2^0$:$2^1$:$2^2$: . . . : $2^{(n-2)}$:$2^{(n-1)}$. The combination of the above display periods enables the display of a desired gradation among $2^n$ gradations.

The total sum of the lengths of the display periods during which the display OLED emits light in the one frame period is found, whereby the gradation displayed by the display pixel in the frame period concerned is determined. For example, in case of n=8, it is assumed that the luminance in the case where the display pixel emits light in all the display periods is 100%. When the display pixel emits light in Tr1 and Tr2, a luminance of 1% can be exhibited. When Tr3, Tr5 and Tr8 are selected, a luminance of 60% can be exhibited.

Further, the display periods Tr1 to Trn may be appeared in any order. For example, the display periods may be appeared in the order of Tr1, Tr3, Tr5, Tr2, . . . in the one frame period.

Note that, although the height of the power supply potential of the power supply line is changed between the writing periods and the display periods, the present invention is not limited to this. Both the power supply potential and the potential of the opposing electrode may always have the potential difference with an extent such that the display OLED emits light when the power supply potential is given to the pixel electrode of the display OLED. In this case, the display OLED can be made to emit light also in the writing periods. Thus, the gradation displayed by the display pixel in the frame period concerned is determined based on the total sum of the lengths of the writing periods and the display periods during which the display OLED emits light in the one frame period. Note that, in this case, the ratio of the sums of the lengths of the writing periods and the display periods corresponding to the digital video signals of respective bits needs to be (Ta1+Tr1):(Ta2+Tr2):(Ta3+Tr3): . . . : (Ta(n−1)+Tr(n−1)):(Tan+Trn)=$2^0$:$2^1$:$2^2$: . . . :$2^{(n-2)}$:$2^{(n-1)}$.

Note that the driving method shown in this embodiment is just one example, and the driving method of the light emitting device of the present invention in FIG. 1 and FIG. 4 is not limited to the driving method in this embodiment. The light emitting device of the present invention shown in FIG. 1 and FIG. 4 can perform the display with analogue video signals.

Note that this embodiment can be implemented by being freely combined with Embodiment 1 or 3.

[Embodiment 5]

In this embodiment, a detailed structure of a source line driving circuit, a gate line driving circuit, which are used for driving a pixel portion of a light emitting device of the present invention are explained.

Figure 10A:
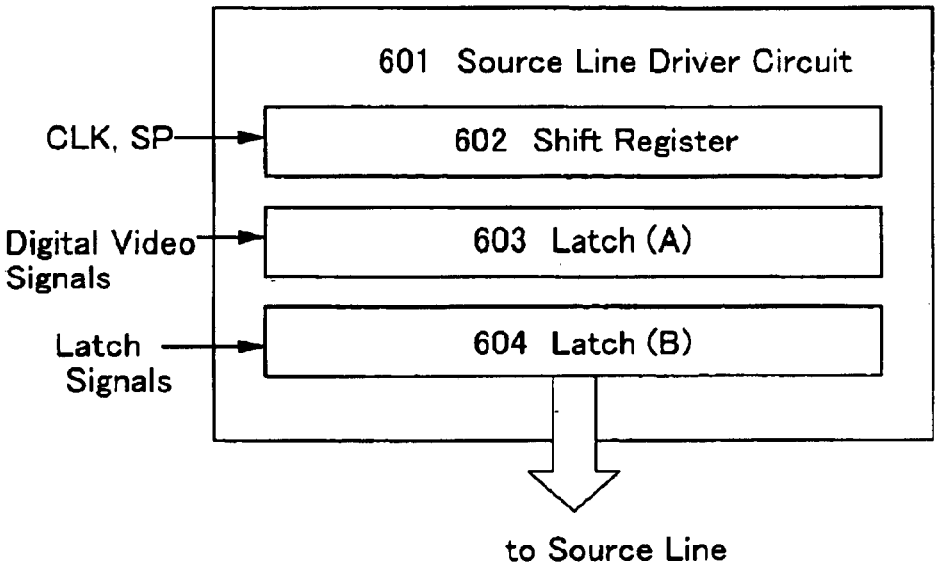
FIGS. 10A and 10B are block diagrams of driver circuits.
Figure 10B:
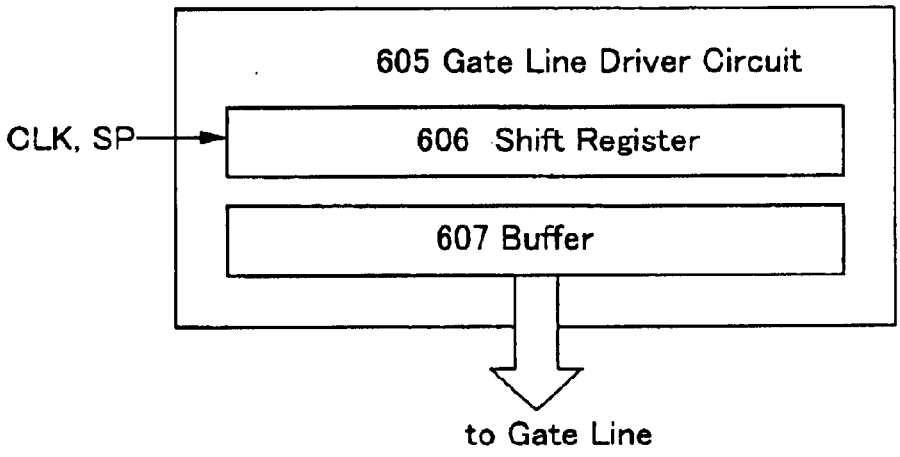

The block figure of a light emitting device of this embodiment is shown in FIGS. 10A and 10B. FIG. 10A shows the source signal line driving 601, which has a shift register 602, a latch (A) 603, and a latch (B) 604.

A clock signal CLK and a start pulse SP are input to the shift register 602 in the source signal line driving circuit 601. The shift register 602 generates timing signals in order based upon the clock signal CLK and the start pulse SP, and supplies the timing signals one after another to the subsequent stage circuit through the buffer (not illustrated) and the like.

Note that, the timing signals output from the shift register circuit 602 may be buffer amplified by a buffer and the like. The load capacitance (parasitic capacitance) of a wiring to which the timing signals are supplied is large because many of the circuits or elements are connected to the wiring. The buffer is formed in order to prevent bluntness in the rise and fall of the timing signal, generated due to the large load capacitance. In addition, the buffer is not always necessary provided.

The timing signal amplified by a buffer is inputted to the latch (A) 603. The latch (A) 603 has a plurality of latch stages for processing digital video signals. The latch (A) 603 writes in and maintains the digital video signal input from external of the source signal line driving circuit 601, when the timing signal is input.

Note that the digital video signal may also be input in order to the plurality of latch stages of the latch (A) 603 in writing in the digital video signal to the latch (A) 603. However, the present invention is not limited to this structure. The plurality of latch stages of the latch (A) 603 may be divided into a certain number of groups, and the digital video signal may be input to the respective groups at the same time in parallel, performing partitioned driving. For example, when the latches are divided into groups every four stages, it is referred to as partitioned driving with 4 divisions.

The period during which the digital video signal is completely written into all of the latch stages of the latch (A) 603 is referred to as a line period. In practice, there are cases in which the line period includes the addition of a horizontal return period to the above line period.

One line period is completed, the latch signal is inputted to the latch (B) 604. At the moment, the digital video signal written into and stored in the latch (A) 603 is send all together to be written into and stored in all stages of the latch (B) 604.

In the latch (A) 603 after completing sending the digital video signal to the latch (B) 604, it is performed to write into the digital video signal in accordance with the timing signal from the shift resister 602.

In the second ordered one line period, the digital video signal which is written into and stored in the latch (B) 604 is inputted to the source signal line.

FIG. 10B is a block figure showing the structure of gate line driving circuit.

The gate line driving circuit 605 has the shift resister 606 and the buffer 607. According to circumstances, the level shift is provided.

In the address gate line driving circuit 605, the timing signal from the shift resister 606 is inputted to the buffer 607, and then to a corresponding gate line. The gate electrodes of the TFTs for one line of pixels are connected to the gate lines, and all of the TFTs of the one line of pixels must be placed in an ON state simultaneously. A circuit which is capable of handling the flow of a large electric current is therefore used for the buffer.

Further, the source signal driving circuit can be provided specially by the pixel portion for display and the pixel portion for monitor.

The driving circuit shown in this embodiment is mere an example. Note that it is possible to implement Embodiment 5 in combination with Embodiments 1 to 4.

[Embodiment 6]

In this embodiment, an appearance of the light emitting device of the present invention is described with reference to FIGS. 11A to 11C.

Figure 11A:
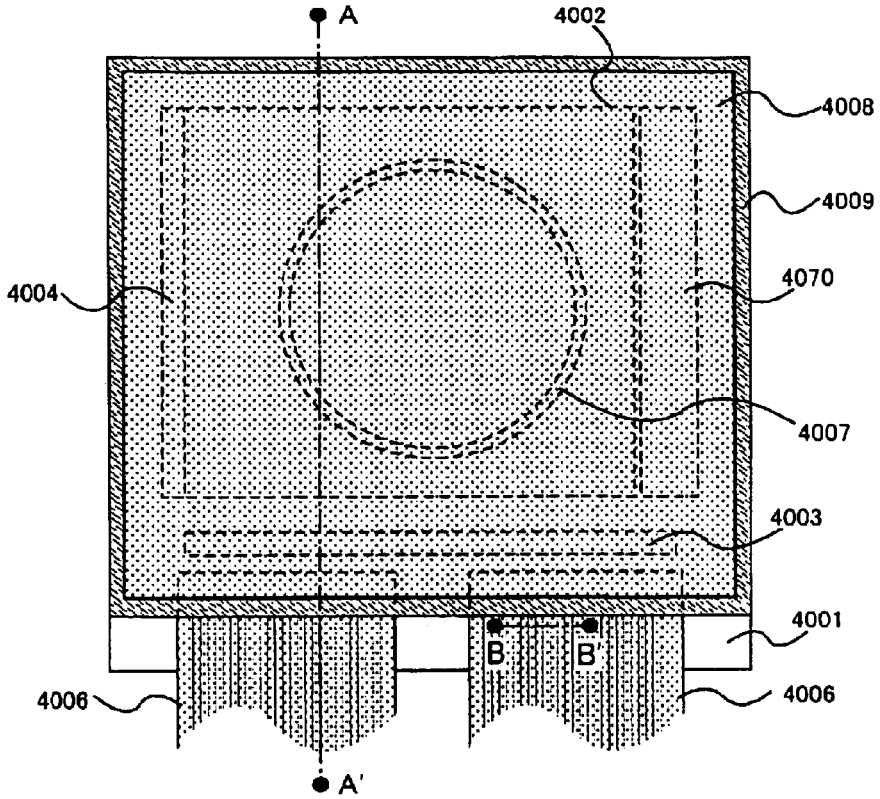
FIGS. 11A to 11C show an appearance of the light emitting device of the present invention.
Figure 11B:
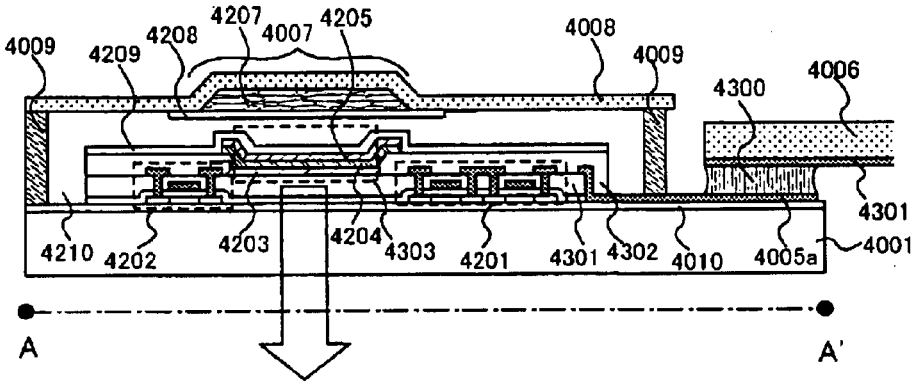
Figure 11C:
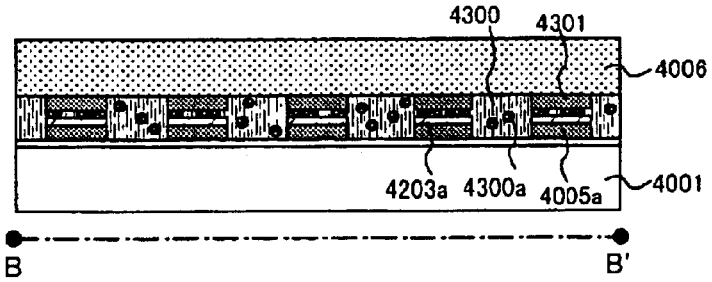

FIG. 11A is a top view of the light emitting device, FIG. 11B is a cross sectional view taken along with a line A–A' of FIG. 11A, and FIG. 11C is a cross sectional view taken along with a line B–B' of FIG. 11A.

A seal member 4009 is provided so as to surround a display pixel portion 4002, a monitor pixel portion 4070, a source line driver circuit 4003 and a gate line driver circuit 4004, which are provided on a substrate 4001. Further, a sealing material 4008 is provided on the display pixel portion 4002, the monitor pixel portion 4070, the source line driver circuit 4003 and the gate line driver circuit 4004. Thus, the display pixel portion 4002, the monitor pixel portion 4070, the source line driver circuit 4003 and the gate line driver circuit 4004 are sealed by the substrate 4001, the seal member 4009 and the sealing material 4008 together with a filler 4210.

Further, the display pixel portion 4002, the monitor pixel portion 4070, the source line driver circuit 4003 and the gate line driver circuit 4004, which are provided on the substrate 4001, have a plurality of TFTs. In FIG. 11B, a driver circuit TFT (Here, an n-channel TFT and a p-channel TFT are shown in the figure.) 4201 included in the source line driver circuit 4003 and a driving TFT (TFT for controlling the current to the OLED) 4202 included in the display pixel portion 4002, which are formed on a base film 4010, are typically shown.

In this embodiment, the p-channel TFT or the n-channel TFT manufactured by a known method is used as the driver circuit TFT 4201, and the p-channel TFT manufactured by a known method is used as the driving TFT 4202. Further, the display pixel portion 4002 is provided with a storage capacitor (not shown) connected to a gate electrode of the driving TFT 4202.

An interlayer insulating film (leveling film) 4301 is formed on the driver circuit TFT 4201 and the driving TFT 4202, and a pixel electrode (anode) 4203 electrically connected to a drain of the driving TFT 4202 is formed thereon. A transparent conductive film having a large work function is used for the pixel electrode 4203. A compound of indium oxide and tin oxide, a compound of indium oxide and zinc oxide, zinc oxide, tin oxide or indium oxide can be used for the transparent conductive film. The above transparent conductive film added with gallium may also be used.

Then, an insulating film 4302 is formed on the pixel electrode 4203, and the insulating film 4302 is formed with an opening portion on the pixel electrode 4203. In this opening portion, an organic light emitting layer 4204 is formed on the pixel electrode 4203. A known organic light emitting material or inorganic light emitting material may be used for the organic light emitting layer 4204. Further, there exist a low molecular weight (monomer) material and a high molecular weight (polymer) material as the organic light emitting materials, and both the materials may be used.

A known evaporation technique or application technique may be used as a method of forming the organic light emitting layer 4204. Further, the structure of the organic light emitting layer may take a lamination structure or a single layer structure by freely combining a hole injecting layer, a hole transporting layer, a light emitting layer, an electron transporting layer and an electron injecting layer.

A cathode 4205 made of a conductive film having light shielding property (typically, conductive film containing aluminum, copper or silver as its main constituent or lamination film of the above conductive film and another conductive film) is formed on the organic light emitting layer 4204. Further, it is desirable that moisture and oxygen that exist on an interface of the cathode 4205 and the organic light emitting layer 4204 are removed as much as possible. Therefore, such a device is necessary that the organic light emitting layer 4204 is formed in a nitrogen or rare gas atmosphere, and then, the cathode 4205 is formed without exposure to oxygen and moisture. In this embodiment, the above-described film deposition is enabled by using a multi-chamber type (cluster tool type) film forming device. In addition, a predetermined voltage is given to the cathode 4205.

As described above, a display OLED 4303 constituted of the pixel electrode (anode) 4203, the organic light emitting layer 4204 and the cathode 4205 is formed. Further, a protective film 4209 is formed on the insulating film 4302 so as to cover the display OLED 4303. The protective film 4209 is effective in preventing oxygen, moisture and the like from permeating the display OLED 4303.

Reference numeral 4005*a* denotes a wiring drawn to be connected to the power supply line, and the wiring 4005*a* is electrically connected to a source region of the driving TFT 4202. The drawn wiring 4005*a* passes between the seal member 4009 and the substrate 4001, and is electrically connected to an FPC wiring 4301 of an FPC 4006 through an anisotropic conductive film 4300.

A glass material, a metal material (typically, stainless material), a ceramics material or a plastic material (including a plastic film) can be used for the sealing material 4008. As the plastic material, an FRP (fiberglass-reinforced plastics) plate, a PVF (polyvinyl fluoride) film, a Mylar film, a polyester film or an acrylic resin film may be used. Further, a sheet with a structure in which an aluminum foil is sandwiched with the PVF film or the Mylar film can also be used.

However, in the case where the light from the display OLED is emitted toward the cover member side, the cover member needs to be transparent. In this case, a transparent substance such as a glass plate, a plastic plate, a polyester film or an acrylic film is used.

Further, in addition to an inert gas such as nitrogen or argon, an ultraviolet curable resin or a thermosetting resin may be used as the filler 4210, so that PVC (polyvinyl chloride), acrylic, polyimide, epoxy resin, silicone resin. PVB (polyvinyl butyral) or EVA (ethylene vinyl acetate) can be used. In this embodiment, nitrogen is used for the filler.

Moreover, a concave portion 4007 is provided on the surface of the sealing material 4008 on the substrate 4001 side, and a hygroscopic substance or a substance that can absorb oxygen 4207 is arranged therein in order that the filler 4210 is made to be exposed to the hygroscopic substance (preferably, barium oxide) or the substance that can absorb oxygen. Then, the hygroscopic substance or the substance that can absorb oxygen 4207 is held in the concave portion 4007 by a concave portion cover member 4208 such that the hygroscopic substance or the substance that can absorb oxygen 4207 is not scattered. Note that the concave portion cover member 4208 has a fine mesh form, and has a structure in which air and moisture are penetrated while the hygroscopic substance or the substance that can absorb oxygen 4207 is not penetrated. The deterioration of the display OLED 4303 can be suppressed by providing the hygroscopic substance or the substance that can absorb oxygen 4207.

As shown in FIG. 11C, the pixel electrode 4203 is formed, and at the same time, a conductive film 4203*a* is formed so as to contact the drawn wiring 4005*a*.

Further, the anisotropic conductive film 4300 has conductive filler 4300*a*. The conductive film 4203*a* on the substrate 4001 and the FPC wiring 4301 on the FPC 4006 are electrically connected to each other by the conductive filler 4300*a* by heat-pressing the substrate 4001 and the FPC 4006.

Incidentally, the light emitted from the monitor pixel portion may penetrate the substrate 4001 or the cover member 4208 or not. In the case where the light penetrates the substrate 4001 or the cover member 4208, the image displayed in the monitor pixel portion can be effectively utilized for displaying something.

The ammeter, the variable power supply and the correction circuit of the light emitting device of the present invention are formed on a substrate (not shown) different from the substrate 4001, and are electrically connected to the power supply line and the cathode 4205, which are formed on the substrate 4001, through the FPC 4006.

Note that this embodiment can be implemented by being freely combined with Embodiments 1 to 5.

[Embodiment 7]

In this embodiment, an example is described in which the ammeter, the variable power supply and the correction circuit of the light emitting, device of the present invention are formed on a substrate different from the substrate on which the display pixel portion is formed, and are connected to the wirings on the substrate on which the display pixel portion is formed by a means such as a wire bonding method or a COG (chip-on-glass) method.

Figure 12:
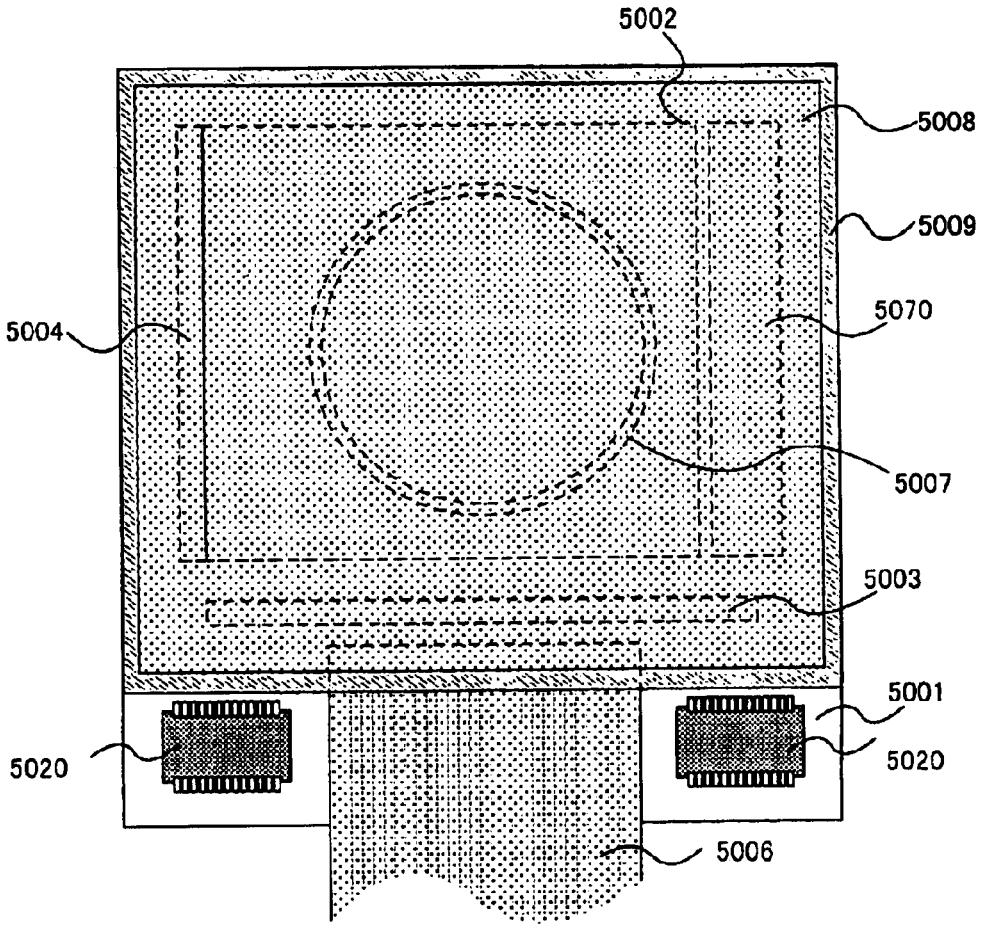
FIG. 12 shows an appearance of the light emitting device of the present invention.

FIG. 12 is a diagram of an appearance of a light emitting device of this embodiment. A seal member 5009 is provided so as to surround a display pixel portion 5002, a monitor pixel portion 5070, a source line driver circuit 5003 and a gate line driver circuit 5004 which are provided on a substrate 5001. Further, a sealing material 5008 is provided on the display pixel portion 5002, the monitor pixel portion 5070, the source line driver circuit 5003 and the gate line driver circuit 5004. Thus, the display pixel portion 5002, the monitor pixel portion 5070, the source line driver circuit 5003 and the gate line driver circuit 5004 are sealed by the substrate 5001, the seal member 5009 and the sealing member 5008 together with a filler (not shown).

A concave portion 5007 is provided on the surface of the sealing material 5008 on the substrate 5001 side, and a hygroscopic substance or a substance that can absorb oxygen is arranged therein.

A wiring (drawn wiring) drawn onto the substrate 5001 passes between the seal member 5009 and the substrate 5001, and is connected to an external circuit or element of the light emitting device through an FPC 5006.

The ammeter, the variable power supply and the correction circuit of the light emitting device of the present invention are formed on a substrate (hereinafter referred to as chip) 5020 different from the substrate 5001. The chip 5020 is attached onto the substrate 5001 by the means such as the COG (chip-on-glass) method, and is electrically connected to the power supply line and a cathode (not shown) which are formed on the substrate 5001.

In this embodiment, the chip 5020 on which the ammeter, the variable power supply and the correction circuit are formed is attached onto the substrate 5001 by the wire bonding method, the COG method or the like. Thus, the light emitting device can be structured based on one substrate, and therefore, the device itself is made compact and also the mechanical strength is improved.

Note that a known method can be applied with regard to a method of connecting the chip onto the substrate. Further, circuits and elements other than the ammeter, the variable power supply and the correction circuit may be attached onto the substrate 5001.

This embodiment can be implemented by being freely combined with Embodiments 1 to 6.

[Embodiment 8]

In the present invention, an external light emitting quantum efficiency can he remarkably improved by using an organic material by which phosphorescence from a triplet exciton can be employed for emitting a light. As a result, the power consumption of the OLED can be reduced, the lifetime of the OLED can be elongated and the weight of the OLED can be lightened.

The following is a report where the external light emitting quantum efficiency is improved by using the triplet exciton (T. Tsutsui, C. Adachi. S. Saito, Photochemical processes in Organized Molecular Systems, ed. K. Honda, (Elsevier Sci. Pub., Tokyo. 1991) p. 437).

The molecular formula of an organic light emitting material (coumarin pigment) reported by the above article is represented as follows.

(Chemical formula 1)

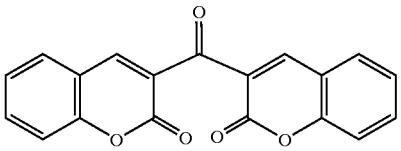

(M. A. Baldo, D. F. O'Brien, Y. You, A. Shoustikov, S. Sibley, M. E. Thompson. S. R. Forrest, Nature 395 (1998) p.151)

The molecular formula of an organic light emitting material (Pt complex) reported by the above article is represented as follows.

(Chemical formula 2)

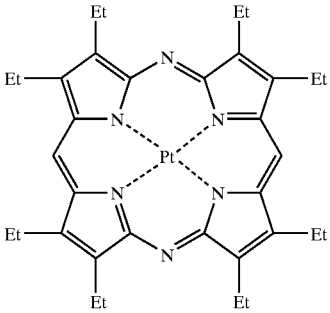

(M. A. Baldo, S. Lamansky. P. E. Burrows, M. E. Thompson. S. R. Forrest, Appl. Phys. Lett., 75 (1999) p.4.) (T. Tsutsui, M.-J. Yang, M. Yahiro, K. Nakamura. T. Watanabe. T. Tsuji. Y. Fukuda. T. Wakimoto, S. Mayaguchi. Jpn. Appl. Phys., 38 (12B) (1999) L1502)

The molecular formula of an organic light emitting material (Ir complex) reported by the above article is represented as follows.

(Chemical formula 3)

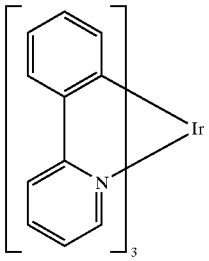

As described above, if phosphorescence from a triplet exciton can be put to practical use, it can realize the external light emitting quantum efficiency three to four times as high as that in the case of using fluorescence from a singlet exciton in principle.

The structure according to this embodiment can be freely implemented in combination of any structures of the Embodiments 1 to 7.

[Embodiment 9]

Next, described with reference to FIGS. 13 to 16 is a method of forming the light emitting device of the present invention. Here, the method of simultaneously forming, on the same substrate, the switching TFT and the driving TFT of the pixel portion, and the TFTs of a driving portion provided surrounding the pixel portion is described in detail according to steps.

This embodiment uses a substrate 900 of a glass such as barium borosilicate glass or aluminoborosilicate glass as represented by the glass #7059 or the glass #1737 of Corning Co. There is no limitation on the substrate 900 provided it has a property of transmitting light, and there may be used a quartz substrate. There may be further used a plastic substrate having heat resistance capable of withstanding the treatment temperature of this embodiment.

Figures 13A, 13B, 13C, 13D:
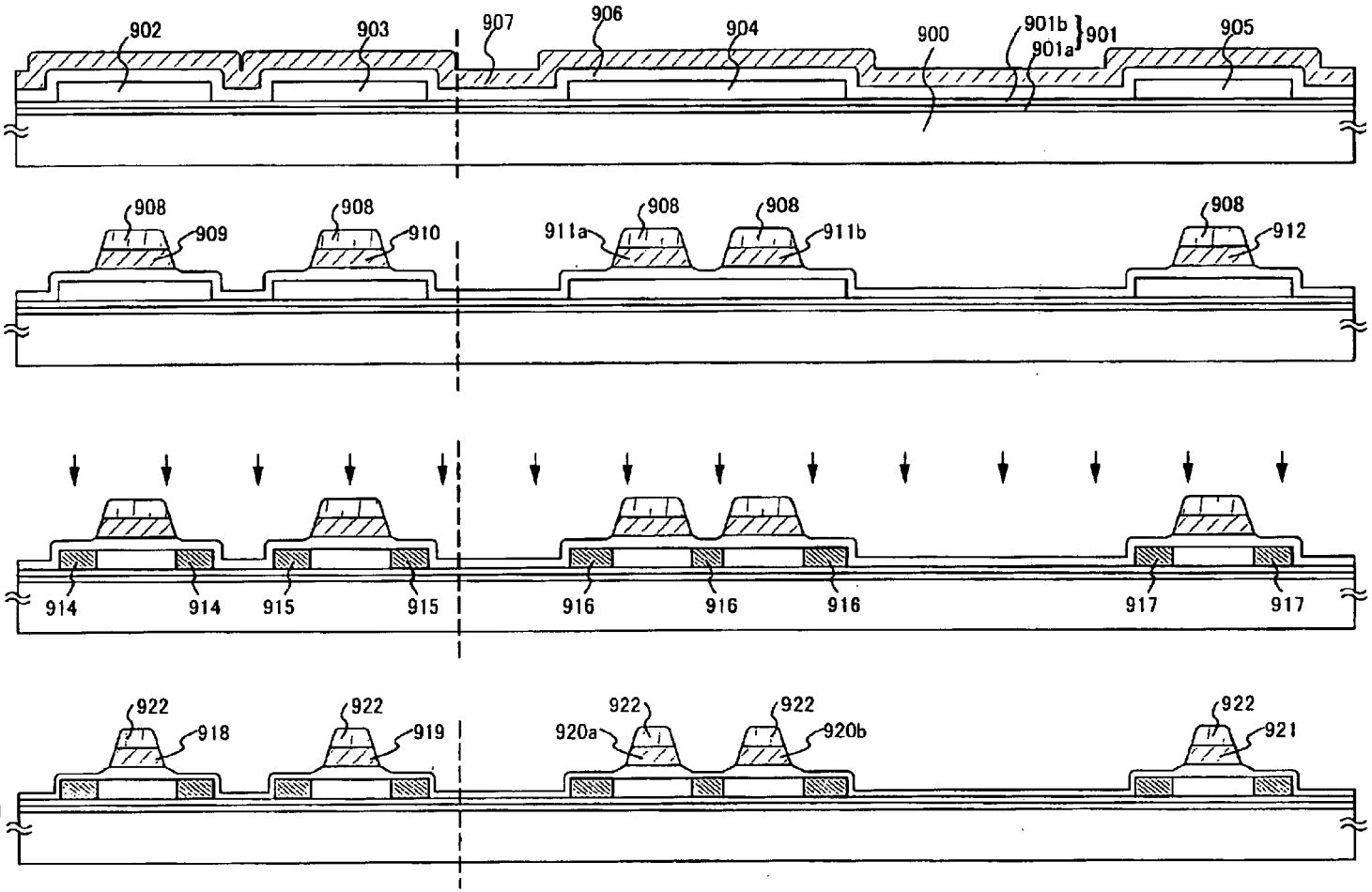
FIGS. 13A to 13D show a method of manufacturing the light emitting device of the present invention.

Referring next to FIG. 13(A), an underlying film 901 comprising an insulating film such as silicon oxide film, silicon nitride film or silicon oxynitride film is formed on the substrate 900. In this embodiment, the underlying film 901 has a two-layer structure. There, however, may be employed a structure in which a single layer or two or more layers are laminated on the insulating film. The first layer of the underlying film 901 is a silicon oxynitride film 901*a* formed maintaining a thickness of from 10 to 200 nm (preferably, from 50 to 100 nm) relying upon a plasma CVD method by using $SiH_4$, $NH_3$ and $N_2O$ as reaction gases. In this embodiment, the silicon oxynitride film 901*a* (having a composition ratio of Si=32%, O=27%, N=24%, H=17%) is formed maintaining a thickness of 50 nm. The second layer of the underlying film 901 is a silicon oxynitride film 901*b* formed maintaining a thickness of from 50 to 200 nm (preferably, from 100 to 150 nm) relying upon the plasma CVD method by using $SiH_4$ and $N_2O$ as reaction gases. In this embodiment, the silicon oxynitride film 901*b* (having a composition ratio of Si=32%, O=59%, N=7%, H=2%) is formed maintaining a thickness of 100 nm.

Then, semiconductor layers 902 to 905 are formed on the underlying film 901. The semiconductor layers 902 to 905 are formed by forming a semiconductor film having an amorphous structure by a known means (sputtering method, LPCVD method or plasma CVD method) followed by a known crystallization processing (laser crystallization method, heat crystallization method or heat crystallization method using a catalyst such as nickel), and patterning the crystalline semiconductor film thus obtained into a desired shape. The semiconductor layers 902 to 905 are formed in a thickness of from 25 to 80 nm (preferably, from 30 to 60 nm). Though there is no limitation on the material of the crystalline semiconductor film, there is preferably used silicon or a silicon-germanium ($Si_xGe_{1-x}$(X=0.0001 to 0.02)) alloy. In this embodiment, the amorphous silicon film is formed maintaining a thickness of 55 nm relying on the plasma CVD method and, then, a solution containing nickel is held on the amorphous silicon film. The amorphous silicon film is dehydrogenated (500° C., one hour), heat-crystallized (550° C., 4 hours) and is, further, subjected to the laser annealing to improve the crystallization, thereby to form a crystalline silicon film. The crystalline silicon film is patterned by the photolithographic method to form semiconductor layers 902 to 905.

The semiconductor layers 902 to 905 that have been formed may further be doped with trace amounts of an impurity element (boron or phosphorus) to control the threshold value of the TFT.

In forming the crystalline semiconductor film by the laser crystallization method, further, there may be employed an excimer laser of the pulse oscillation type or of the continuously light-emitting type, a YAG laser or a $YVO_4$ laser. When these lasers are to be used, it is desired that a laser beam emitted from a laser oscillator is focused into a line through an optical system so as to fall on the semiconductor film. The conditions for crystallization are suitably selected by a person who carries out the process. When the excimer laser is used, the pulse oscillation frequency is set to be 300 Hz and the laser energy density to be from 100 to 400 $mJ/cm^2$ (typically, from 200 to 300 $mJ/cm^2$). When the YAG laser is used, the pulse oscillation frequency is set to be from 30 to 300 kHz by utilizing the second harmonics and the laser energy density to be from 300 to 600 $mJ/cm^2$ (typically, from 350 to 500 $mJ/cm^2$). The whole surface of the substrate is irradiated with the laser beam focused into a line of a width of 100 to 1000 $\mu$m, for example, 400 $\mu$m, and the overlapping ratio of the linear beam at this moment is set to be 50 to 90%.

Then, a gate insulating film 906 is formed to cover the semiconductor layers 902 to 905. The gate insulating film 906 is formed of an insulating film containing silicon maintaining a thickness of from 40 to 150 nm by the plasma CVD method or the sputtering method. In this embodiment, the gate insulating film is formed of a silicon oxynitride film (composition ratio of Si=32%, O=59%, N=7%, H=2%) maintaining a thickness of 110 nm by the plasma CVD method. The gate insulating film is not limited to the silicon oxynitride film but may have a structure on which is laminated a single layer or plural layers of an insulating film containing silicon.

When the silicon oxide film is to be formed, TEOS (tetraethyl orthosilicate) and $O_2$ are mixed together by the plasma CVD method, and are reacted together under a reaction pressure of 40 Pa, at a substrate temperature of from 300 to 400° C., at a frequency of 13.56 MHz and a discharge electric power density of from 0.5 to 0.8 $W/cm^2$. The thus formed silicon oxide film is, then, heat annealed at 400 to 500° C. thereby to obtain the gate insulating film having good properties.

Then, a heat resistant conductive layer 907 is formed on the gate insulating film 906 maintaining a thickness of from 200 to 400 nm (preferably, from 250 to 350 nm) to form the gate electrode. The heat-resistant conductive layer 907 may be formed as a single layer or may, as required, be formed in a structure of laminated layers of plural layers such as two layers or three layers. The heat resistant conductive layer contains an element selected from Ta, Ti and W, or contains an alloy of the above element, or an alloy of a combination of the above elements. The heat-resistant conductive layer is formed by the sputtering method or the CVD method, and should contain impurities at a decreased concentration to decrease the resistance and should, particularly, contain oxygen at a concentration of not higher than 30 ppm. In this embodiment, the W film is formed maintaining a thickness of 300 nm. The W film may be formed by the sputtering method by using W as a target, or may be formed by the hot CVD method by using tungsten hexafluoride ($WF_6$). In either case, it is necessary to decrease the resistance so that it can be used as the gate electrode. It is, therefore, desired that the W film has a resistivity of not larger than 20 $\mu\Omega$cm. The resistance of the W film can be decreased by coarsening the crystalline particles. When W contains much impurity elements such as oxygen, the crystallization is impaired and the resistance increases. When the sputtering method is employed, therefore, a W target having a purity of 99.9999% is used, and the W film is formed while giving a sufficient degree of attention so that the impurities will not be infiltrated from the gaseous phase during the formation of the film, to realize the resistivity of from 9 to 20 $\mu\Omega$cm.

On the other hand, the Ta film that is used as the heat-resistant conductive layer 907 can similarly be formed by the sputtering method. The Ta film is formed by using Ar as a sputtering gas. Further, the addition of suitable amounts of Xe and Kr into the gas during the sputtering makes it possible to relax the internal stress of the film that is formed and to prevent the film from being peeled off. The Ta film of $\alpha$-phase has a resistivity of about 20 $\mu\Omega$cm and can be used as the gate electrode but the Ta film of $\beta$-phase has a resistivity of about 180 $\mu\Omega$cm and is not suited for use as the gate electrode. The TaN film has a crystalline structure close to the $\alpha$-phase. Therefore, if the TaN film is formed under the Ta film, there is easily formed the Ta film of $\alpha$-phase. Further, though not diagramed, formation of the silicon film doped with phosphorus (P) maintaining a thickness of about 2 to about 20 nm under the heat resistant conductive layer 907 is effective in fabricating the device. This helps improve the intimate adhesion of the conductive film formed thereon, prevent the oxidation, and prevent trace amounts of alkali metal elements contained in the heat resistant conductive layer 907 from being diffused into the gate insulating film 906 of the first shape. In any way, it is desired that the heat-resistant conductive layer 907 has a resistivity over a range of from 10 to 50 $\mu\Omega$cm.

Next, a mask 908 is formed by a resist relying upon the photolithographic technology. Then, a first etching is executed. This embodiment uses an ICP etching device, uses $Cl_9$ and $CF_4$ as etching gases, and forms a plasma with RF (13.56 MHz) electric power of 3.2 $W/cm^2$ under a pressure of 1 Pa. The RF (13.56 MHz) electric power of 224 $mW/cm^2$ is supplied to the side of the substrate (sample stage), too, whereby a substantially negative self bias voltage is applied. Under this condition, the W film is etched at a rate of about 100 nm/min. The first etching treatment is effected by estimating the time by which the W film is just etched relying upon this etching rate, and is conducted for a period of time which is 20% longer than the estimated etching time.

The conductive layers 909 to 912 having a first tapered shape are formed by the first etching treatment. The conductive layers 909 to 912 are tapered at an angle of from 15 to 30°. To execute the etching without leaving residue, over-etching is conducted by increasing the etching time by about 10 to 20%. The selection ratio of the silicon oxynitride film (gate insulating film 906) to the W film is 2 to 4 (typically, 3). Due to the over etching, therefore, the surface where the silicon oxynitride film is exposed is etched by about 20 to about 50 nm (FIG. 13(B)).

Then, a first doping treatment is effected to add an impurity element of a first type of electric conduction to the semiconductor layer. Here, a step is conducted to add an impurity element for imparting the n-type. A mask 908 forming the conductive layer of a first shape is left, and an impurity element is added by the ion-doping method to impart the n-type in a self-aligned manner with the conductive layers 909 to 912 having a first tapered shape as masks. The dosage is set to be from $1\times10^{13}$ to $5\times10^{12}$ atoms/$cm^2$ so that the impurity element for imparting the n-type reaches the underlying semiconductor layer penetrating through the tapered portion and the gate insulating film 906 at the ends of the gate electrode, and the acceleration voltage is selected to be from 80 to 160 keV. As the impurity element for imparting the n-type, there is used an element belonging to the Group 15 and, typically, phosphorus (P) or arsenic (As). Phosphorus (P) is used, here. Due to the ion-doping method, an impurity element for imparting the n-type is added to the first impurity regions 914 to 917 over a concentration range of from $1\times10^{20}$ to $1\times10^{21}$ atoms/cm$^3$ (FIG. 13(C)).

In this step, the impurities turn down to the lower side of the conductive layers 909 to 912 of the first shape depending upon the doping conditions, and it often happens that the first impurity regions 914 to 917 are overlapped on the conductive layers 909 to 912 of the first shape.

Next, the second etching treatment is conducted as shown in FIG. 13(D). The etching treatment, too, is conducted by using the ICP etching device, using a mixed gas of $CF_4$ and $Cl_2$ as an etching gas, using an RF electric power of 3.2 W/cm$^2$ (13.56 MHz), a bias power of 45 mW/cm$^2$ (13.56 MHz) under a pressure of 1.0 Pa. Under this condition, there are formed the conductive layers 918 to 921 of a second shape. The end portions thereof are tapered, and the thicknesses gradually increase from the ends toward the inside. The rate of isotropic etching increases in proportion to a decrease in the bias voltage applied to the side of the substrate as compared to the first etching treatment, and the angle of the tapered portions becomes 30 to 60°. The mask 908 is ground at the edge by etching to form a mask 922. In the step of FIG. 13(D), the surface of the gate insulating film 906 is etched by about 40 nm.

Then, the doping is effected with an impurity element for imparting the n-type under the condition of an increased acceleration voltage by decreasing the dosage to be smaller than that of the first doping treatment. For example, the acceleration voltage is set to be from 70 to 120 keV, the dosage is set to be $1\times10^{13}$/cm$^2$ thereby to form first impurity regions 924 to 927 having an increased impurity concentration, and second impurity regions 928 to 931 that are in contact with the first impurity regions 924 to 927. In this step, the impurity may turn down to the lower side of the conductive layers 918 to 921 of the second shape, and the second impurity regions 928 to 931 may be overlapped on the conductive layers 918 to 921 of the second shape. The impurity concentration in the second impurity regions is from $1\times10^{16}$ to $1\times10^{18}$ atoms/cm$^3$ (FIG. 14(A)).

Figures 14A, 14B, 14C:
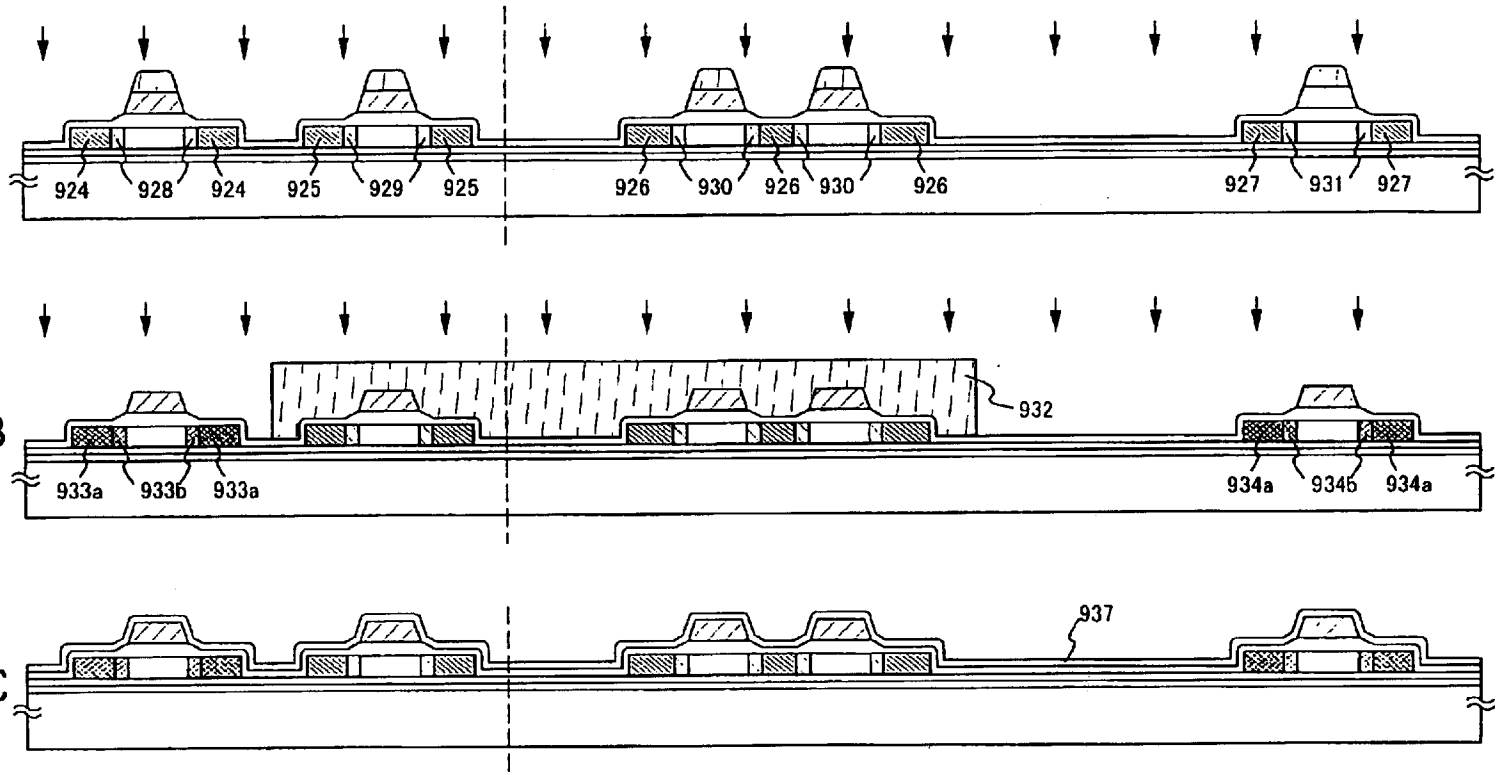
FIGS. 14A to 14C show the method of manufacturing the light emitting device of the present invention.

Referring to FIG. 14(B), impurity regions 933 (933*a*, 933*b*) and 934 (934*a*, 934*b*) of the conduction type opposite to the one conduction type are formed in the semiconductor layers 902, 905 that form the p-channel TFTs. In this case, too, an impurity element for imparting the p-type is added using the conductive layers 918, 921 of the second shape as masks to form impurity regions in a self-aligned manner. At this moment, the semiconductor layers 903 and 904 forming the n-channel TFTs are entirely covered for their surfaces by forming a mask 932 of a resist. Here, the impurity regions 933 and 934 are formed by the ion-doping method by using diborane ($B_2H_6$). The impurity element for imparting the p-type is added to the impurity regions 933 and 934 at a concentration of from $2\times10^{20}$ to $2\times10^{21}$ atoms/cm$^3$.

If closely considered, however, the impurity regions 933, 934 can be divided into two regions containing an impurity element that imparts the n-type. Third impurity regions 933*a* and 934*a* contain the impurity element that imparts the n-type at a concentration of from $1\times10^{20}$ to $1\times10^{21}$ atoms/cm$^3$ and fourth impurity regions 933*b* and 934*b* contain the impurity element that imparts the n-type at a concentration of from $1\times10^{17}$ to $1\times10^{20}$ atoms/cm$^3$. In the impurity regions 933*b* and 934*b*, however, the impurity element for imparting the p-type is contained at a concentration of not smaller than $1\times10^{19}$ atoms/cm$^3$ and in the third impurity regions 933*a* and 934*a*, the impurity element for imparting the p-type is contained at a concentration which is 1.5 to 3 times as high as the concentration of the impurity element for imparting the n-type. Therefore, the third impurity regions work as source regions and drain regions of the p-channel TFTs without arousing any problem.

Referring next to FIG. 14(C), a first interlayer insulating film 937 is formed on the conductive layers 918 to 921 of the second shape and on the gate insulating film 906. The first interlayer insulating film 937 may be formed of a silicon oxide film, a silicon oxynitride film, a silicon nitride film, or a laminated layer film of a combination thereof. In any case, the first interlayer insulating film 937 is formed of an inorganic insulating material. The first interlayer insulating film 937 has a thickness of 100 to 200 nm. When the silicon oxide film is used as the first interlayer insulating film 937, TEOS and 02 are mixed together by the plasma CVD method, and are reacted together under a pressure of 40 Pa at a substrate temperature of 300 to 400° C. while discharging the electric power at a high frequency (13.56 MHz) and at a power density of 0.5 to 0.8 W/cm$^2$. When the silicon oxynitride film is used as the first interlayer insulating film 937, this silicon oxynitride film may be formed from $SiH_4$, $N_2O$ and $NH_3$, or from $SiH_4$ and $N_2O$ by the plasma CVD method. The conditions of formation in this case are a reaction pressure of from 20 to 200 Pa, a substrate temperature of from 300 to 400° C. and a high-frequency (60 MHz) power density of from 0.1 to 1.0 W/cm$^2$. As the first interlayer insulating film 937, further, there may be used a hydrogenated silicon oxynitride film formed by using $SiH_4$, $N_2O$ and $H_2$. The silicon nitride film, too, can similarly be formed by using $SiH_4$ and $NH_3$ by the plasma CVD method.

Then, a step is conducted for activating the impurity elements that impart the n-type and the p-type added at their respective concentrations. This step is conducted by thermal annealing method using an annealing furnace. There can be further employed a laser annealing method or a rapid thermal annealing method (RTA method). The thermal annealing method is conducted in a nitrogen atmosphere containing oxygen at a concentration of not higher than 1 ppm and, preferably, not higher than 0.1 ppm at from 400 to 700° C. and, typically, at from 500 to 600° C. In this embodiment, the heat treatment is conducted at 550° C. for 4 hours. When a plastic substrate having a low heat resistance temperature is used as the substrate 501, it is desired to employ the laser annealing method.

Following the step of activation, the atmospheric gas is changed, and the heat treatment is conducted in an atmosphere containing 3 to 100% of hydrogen at from 300 to 450° C. for from 1 to 12 hours to hydrogenate the semiconductor layer. This step is to terminate the dangling bonds of $10^{16}$ to $10^{8}$/cm$^3$ in the semiconductor layer with hydrogen that is thermally excited. As another means of hydrogenation, the plasma hydrogenation may be executed (using hydrogen excited with plasma). In any way, it is desired that the defect density in the semiconductor layers 902 to 905 is suppressed to be not larger than $10^{16}$/cm$^3$. For this purpose, hydrogen may be added in an amount of from 0.01 to 0.1 atomic %.

Then, a second interlayer insulating film 939 of an organic insulating material is formed maintaining an average thickness of from 1.0 to 2.0 $\mu$m. As the organic resin material, there can be used polyimide, acrylic resin, polyamide, polyimideamide, BCB (benzocyclobutene). When there is used, for example, a polyimide of the type that is heat polymerized after being applied onto the substrate, the second interlayer insulating film is formed being fired in a clean oven at 300° C. When there is used an acrylic resin, there is used the one of the two-can type. Namely, the main material and a curing agent are mixed together, applied onto the whole surface of the substrate by using a spinner, pre-heated by using a hot plate at 80° C. for 60 seconds, and are fired at 250° C. for 60 minutes in a clean oven to form the second interlayer insulating film.

Thus, the second interlayer insulating film 939 is formed by using an organic insulating material featuring good and flattened surface. Further, the organic resin material, in general, has a small dielectric constant and lowers the parasitic capacitance. The organic resin material, however, is hygroscopic and is not suited as a protection film. It is, therefore, desired that the second interlayer insulating film is used in combination with the silicon oxide film, silicon oxynitride film or silicon nitride film formed as the first interlayer insulating film 937.

Thereafter, the resist mask of a predetermined pattern is formed, and contact holes are formed in the semiconductor layers to reach the impurity regions serving as source regions or drain regions. The contact holes are formed by dry etching. In this case, a mixed gas of $CF_4$. $O_2$ and He is used as the etching gas to, first, etch the second interlayer insulating film 939 of the organic resin material. Thereafter, $CF_4$ and $O_2$ are used as the etching gas to etch the first interlayer insulating film 937. In order to further enhance the selection ratio relative to the semiconductor layer. $CHF_3$ is used as the etching gas to etch the gate insulating film 570 of the third shape, thereby to form the contact holes.

Here, the conductive metal film is formed by sputtering and vacuum vaporization and is patterned by using a mask and is, then, etched to form source wirings 940 to 943, drain wirings 944 to 946. Further, though not diagramed in this embodiment, the wiring is formed by a laminate of a 50 nm thick Ti film and a 500 nm thick alloy film (alloy film of Al and Ti).

Figure 15A:
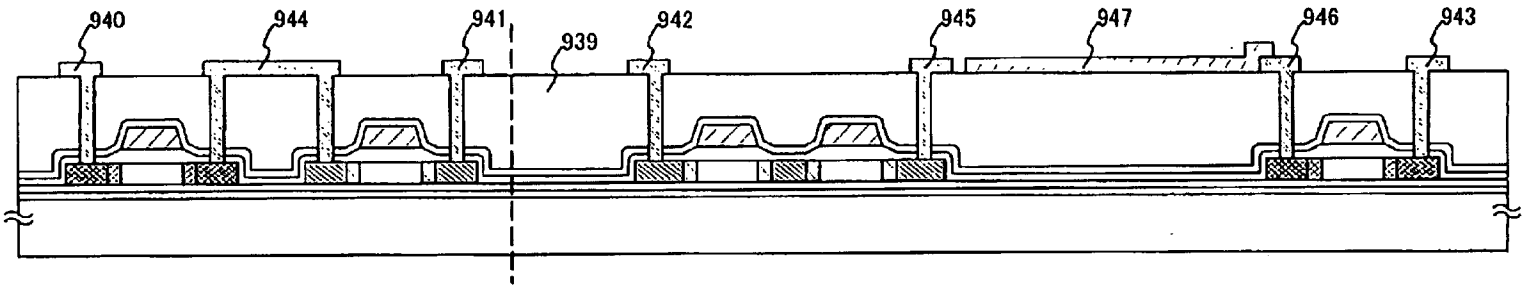
FIGS. 15A and 15B show the method of manufacturing the light emitting device of the present invention.

Then, a transparent conductive film is formed thereon maintaining a thickness of 80 to 120 nm, and is patterned to form a pixel electrode 947 (FIG. 15(A)). Therefore, the pixel electrode 947 is formed by using an indium oxide-tin (ITO) film as a transparent electrode or a transparent conductive film obtained by mixing 2 to 20% of a zinc oxide (ZnO) into indium oxide.

Further, the pixel electrode 947 is formed being in contact with, and overlapped on, the drain wiring 946 that is electrically connected to the drain region of the driving TFT.

Figure 15B:
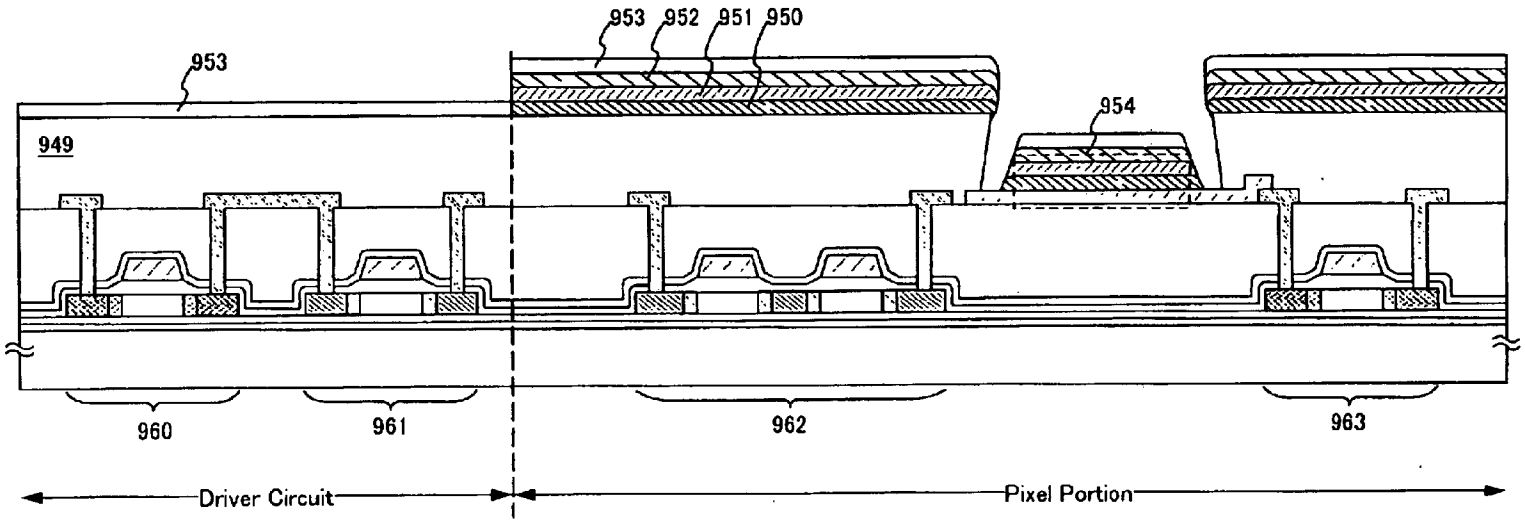

Next, a third interlayer insulating film 949 having an opening at the position that coincides with the pixel electrode 947 is formed as shown in FIG. 15(B). The third interlayer insulating film 949 is capable of insulating, and functions as a bank to separate organic light emitting layers of adjacent pixels from one another. In this embodiment, a resist is used to form the third interlayer insulating film 949.

In this embodiment, the third interlayer insulating film 949 is about 1 $\mu$m in thickness and the aperture is shaped to have a so-called reverse tapered shape in which the width is increased toward the pixel electrode 947. This is obtained by covering the resist film with a mask except the portion where the aperture is to be formed, exposing the film through irradiation of UV light, and then removing the exposed portion using a developer.

The third interlayer insulating film 949 reversely tapered as in this embodiment separates organic light emitting layers of adjacent pixels from each other when the organic light emitting layers are formed in a later step. Therefore cracking or peeling of the organic light emitting layers can be prevented even if the organic light emitting layers and the third interlayer insulating film 949 have different thermal expansion coefficient.

Although a resist film is used in this embodiment for the third interlayer insulating film, polyimide, polyamide, acrylic, BCB (benzocycrobutene), or silicon oxide film may be used in some cases. The third interlayer insulating film 949 may be organic or inorganic as long as the material is capable of insulating.

An organic light emitting layer 950 is formed by evaporation. A cathode (MgAg electrode) 951 and a protective electrode 952 are also formed by evaporation. Desirably, heat treatment is performed on the pixel electrode 947 to remove moisture completely from the electrode before forming the organic light emitting layer 950 and the cathode 951. Though the cathode of OLED is a MgAg electrode in this embodiment, other known materials may be used instead.

The organic light emitting layer 950 can be formed from a known material. In this embodiment, the organic light emitting layer has a two-layer structure consisting of a hole transporting layer and a light emitting layer. The organic light emitting layer may additionally have a hole injection layer, an electron injection layer, or an electron transporting layer. Various combinations of these layers have been reported and any of them can be used.

In this embodiment, the hole transporting layer is polyphenylene vinylene deposited by evaporation. The light emitting layer is obtained by evaporation of polyvinyl carbazole with molecular dispersion of 30 to 40% of PBD that is a 1, 3, 4-oxadiazole derivative and by doping the resultant film with about 1% of coumarine 6 as green color luminescent center.

The protective electrode 952 alone can protect the organic light emitting layer 950 from moisture and oxygen but adding a protective film 953 is more desirable. The protective film 953 in this embodiment is a silicon nitride film with a thickness of 300 nm. The protective electrode 952 and the protective film may be formed in succession without exposing the substrate to the air.

The protective electrode 952 also prevents degradation of the cathode 951. Typically, a metal film containing aluminum as its main ingredient is used for the protective electrode. Other materials may of course be used. The organic tight emitting layer 950 and the cathode 951 are very weak against moisture. Therefore it is desirable to form them and the protective electrode 952 in succession without exposing the substrate to the air to protect them from the outside air.

The organic light emitting layer 950 is 10 to 400 nm in thickness (typically 60 to 150 nm). The cathode 951 is 80 to 200 nm in thickness (typically 100 to 150 nm).

Thus completed is a light emitting device structured as shown in FIG. 15B. A portion 954 where the pixel electrode 947, the organic light emitting layer 950, and the cathode 951 overlap corresponds to the OLED.

A p-channel TFT 960 and an n-channel TFT 961 are TFTs of the driving circuit and constitute a CMOS. A switching TFT 962 and a driving TFT 963 are TFTs of the pixel portion. The TFTs of the driving circuit and the TFTs of the pixel portion can be formed on the same substrate.

In the case of a light emitting device using OLED, its driving circuit can be operated by a power supply having a voltage of 5 to 6V, 10 V, at most. Therefore, degradation of TFTs due to hot electron is not a serious problem. Also, smaller gate capacitance is preferred for the TFTs since the driving circuit needs to operate at high speed. Accordingly, in a driving circuit of a light emitting device using OLED as in this embodiment, the second impurity region 929 and the fourth impurity region 933*b* of the semiconductor layers of the TFTs preferably do not overlap the gate electrode 918 and the gate electrode 919, respectively.

The method of manufacturing the light emitting device of the present invention is not limited to the one described in this embodiment. The light emitting device of the present invention may be manufactured by a known method.

This embodiment may be combined freely with Embodiments 1 through 8.

[Embodiment 10]

In this embodiment, a method of manufacturing a light emitting device different from that in Embodiment 9 is described.

Figure 16A:
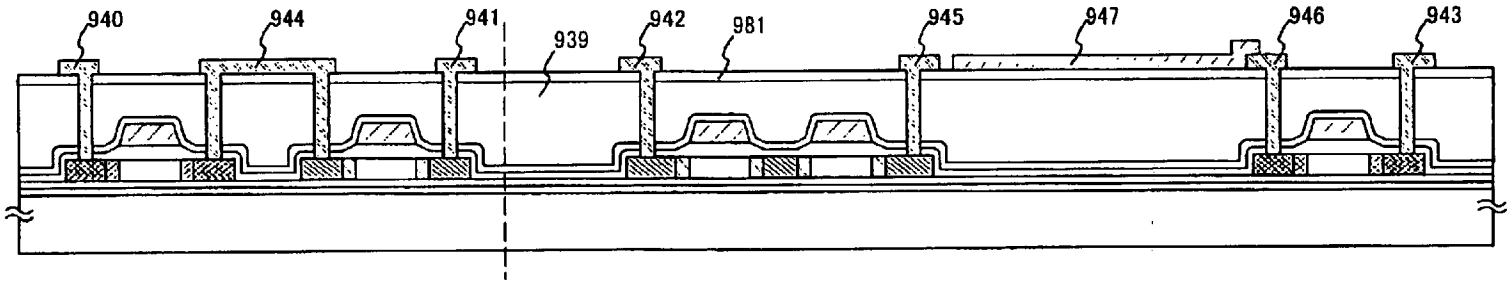
FIGS. 16A and 16B show a method of manufacturing the light emitting device of the present invention.

The process through the formation of the second interlayer insulating film 939 is the same as in Embodiment 5. As shown in FIG. 16A, after the second interlayer insulating film 939 is formed, a passivation film 981 is formed so as to contact the second interlayer insulating film 939.

The passivation film 981 is effective in preventing moisture contained in the second interlayer insulating film 939 from permeating the organic light emitting layer 950 through the pixel electrode 947 or a third interlayer insulating film 982. In the case where the second interlayer insulating film 939 includes an organic resin material, it is particularly effective to provide the passivation film 981 since the organic resin material contains a large amount of moisture.

In this embodiment, a silicon nitride film is used as the passivation film 981.

Thereafter, a resist mask having a predetermined pattern is formed, and contact holes reaching impurity regions, which are source regions or drain regions, are formed in the respective semiconductor layers. The contact holes are formed by a dry etching method. In this case, the second interlayer insulating film 939 comprised of the organic resin material is first etched by using a gas mixture of $CF_4$, $O_2$ and He as an etching gas. Subsequently, the first interlayer insulating film 937 is etched with $CF_4$ and $O_2$ as an etching gas. Further, in order to raise a selection ratio with the semiconductor layer, the etching gas is changed to $CHF_3$ to etch the third shape gate insulating film 906, whereby the contact holes can be formed.

Then, a conductive metal film is formed by a sputtering method or a vacuum evaporation method, patterning is performed with a mask, and thereafter, etching is performed. Thus, the source wirings 940 to 943 and the drain wirings 944 to 946 are formed. Although not shown, the wirings are formed of a lamination film of a Ti film with a thickness of 50 nm and an alloy film with a thickness of 500 nm (alloy film of Al and Ti) in this embodiment.

Subsequently, a transparent conductive film is formed thereon with a thickness of 80 to 120 nm, and the pixel electrode 947 is formed by patterning (FIG. 16A). Note that an indium-tin oxide (ITO) film or a transparent conductive film in which indium oxide is mixed with 2 to 20% of zinc oxide (ZnO) is used for a transparent electrode in this embodiment.

Further, the pixel electrode 947 is formed so as to contact and overlap the drain wiring 946. Thus, electrical connection between the pixel electrode 947 and the drain region of the driving TFT is formed.

Figure 16B:
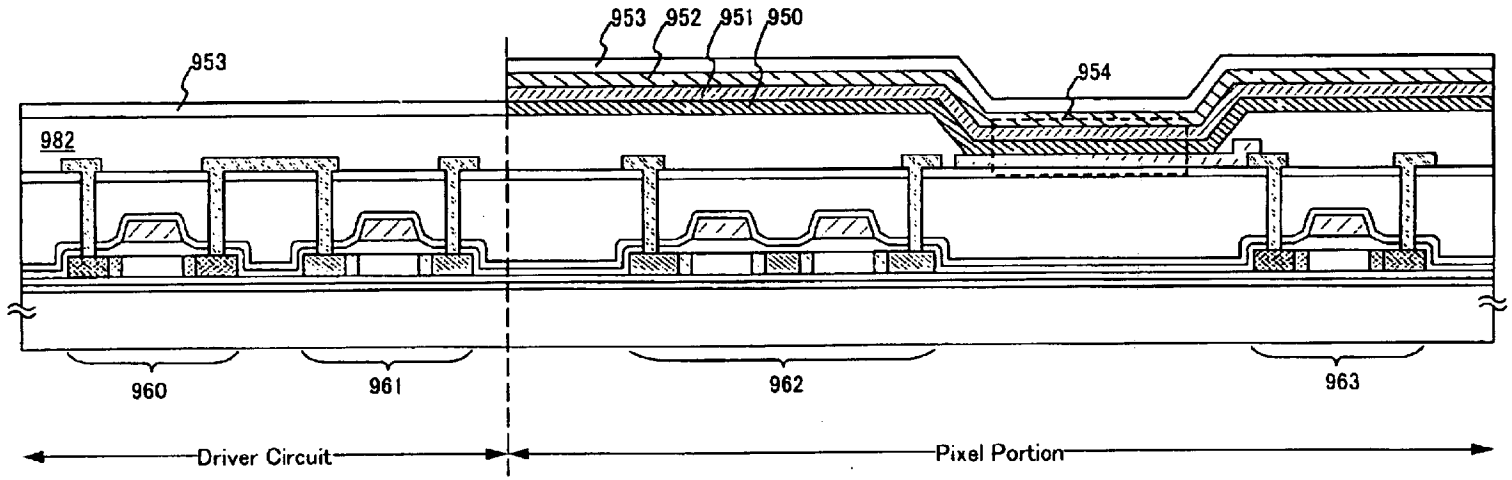

Next, as shown in FIG. 16B, the third interlayer insulating film 982 having an opening portion at the position corresponding to the pixel electrode 947 is formed. In this embodiment, side walls having a tapered shape are formed by using a wet etching method in forming the opening portion. Differently from the case shown in Embodiment 5, the organic light emitting layer formed on the third interlayer insulating film 982 is not separated. Thus, the deterioration of the organic light emitting layer which derives from a step becomes a conspicuous problem if the side walls of the opening portion are not sufficiently gentle, which requires attention.

Note that although a film made of silicon oxide is used as the third interlayer insulating film 982 in this embodiment, an organic resin film such as polyimide, polyamide, acrylic or BCB (benzocyclobutene) may also be used depending on circumstances.

Then, it is preferable that, before the organic light emitting layer 950 is formed on the third interlayer insulating film 982, plasma processing using argon is conducted to the surface of the third interlayer insulating film 982 to make close the surface of the third interlayer insulating film 982. With the above structure, it is possible to prevent moisture from permeating the organic light emitting layer 950 from the third interlayer insulating film 982.

Next, the organic light emitting layer 950 is formed by an evaporation method, and further, the cathode (MgAg electrode) 951 and the protecting electrode 952 are formed by the evaporation method. At this time, it is desirable that heat treatment is conducted to the pixel electrode 947 to completely remove moisture prior to the formation of the organic light emitting layer 950 and the cathode 951. Note that, the MgAg electrode is used as the cathode of the OLED in this embodiment, but other known materials may also be used.

Note that a known material can be used for the organic light emitting layer 950. In this embodiment, the organic light emitting layer takes a two-layer structure constituted of a hole transporting layer and a light emitting layer. However, there may be a case where any one of a hole injecting layer, an electron injecting layer and an electron transporting layer is included in the organic light emitting layer. Various examples of combinations have been reported as described above, and any structure among those may be used.

In this embodiment, polyphenylene vinylene is formed by the evaporation method for forming the hole transporting layer. Further, polyvinylcarbazole dispersed with PBD of 1, 3, 4-oxadiazole derivative with 30 to 40% molecules is formed by the evaporation method for forming the light emitting layer, and about 1% of coumarin 6 is added thereto as the emission center of green color.

Further, it is possible to protect the organic light emitting layer 950 from moisture and oxygen in the protecting electrode 952, but the protective film 953 may be, more preferably, provided. In this embodiment, a silicon nitride film with a thickness of 300 nm is provided as the protective film 953. This protective film may be continuously formed without exposure to an atmosphere after the formation of the protecting electrode 952.

Moreover, the protecting electrode 952 is provided for preventing deterioration of the cathode 951 and is typified by a metal film containing aluminum as its main constituent. Of course, other materials may also be used. Further, since the organic light emitting layer 950 and the cathode 951 are extremely easily affected by moisture, it is desirable that the formation is continuously performed through the formation of the protecting electrode 952 without exposure to an atmosphere to thereby protect the organic light emitting layer against an outer atmosphere.

Note that the thickness of the organic light emitting layer 950 may be 10 to 400 nm (typically, 60 to 150 nm) and the thickness of the cathode 951 may be 80 to 200 nm (typically, 100 to 150 nm).

Thus, the light emitting device with the structure as shown in FIG. 16B is completed. Note that the portion 954, where the pixel electrode 947, the organic light emitting layer 950 and the cathode 951 are overlapped one another, corresponds to the OLED.

The p-channel TFT 960 and the n-channel TFT 961 are the TFTs of the driver circuit, and form a CMOS. The switching TFT 962 and the driving TFT 963 are the TFTs of the pixel portion. The TFTs of the driver circuit and the TFTs of the pixel portion can be formed on the same substrate.

The method of manufacturing the light emitting device of the present invention is not limited to the manufacturing method described in this embodiment. The light emitting device of the present invention can be manufactured by using a known method.

Note that this embodiment can be implemented by freely being combined with Embodiments 1 to 9.

[Embodiment 11]

The light emitting device is of the self-emission type, and thus exhibits more excellent recognizability of the displayed image in a light place as compared to the liquid crystal display device. Furthermore, the light emitting device has a wider viewing angle. Accordingly, the light emitting device can be applied to a display portion in various electronic devices.

Such electronic devices using a light emitting device of the present invention include a video camera, a digital camera, a goggles-type display (head mount display), a navigation system, a sound reproduction device (a car audio equipment and an audio set), note-size personal computer, a game machine, a portable information terminal (a mobile computer, a portable telephone, a portable game machine, an electronic book, or the like), an image reproduction apparatus including a recording medium (more specifically, an apparatus which can reproduce a recording medium such as a digital versatile disc (DVD) and so forth, and includes a display for displaying the reproduced image), or the like. In particular, in the case of the portable information terminal, use of the light emitting device is preferable, since the portable information terminal that is likely to be viewed from a tilted direction is often required to have a wide viewing angle. FIGS. 17A to 17H respectively shows various specific examples of such electronic devices.

Figure 17A:
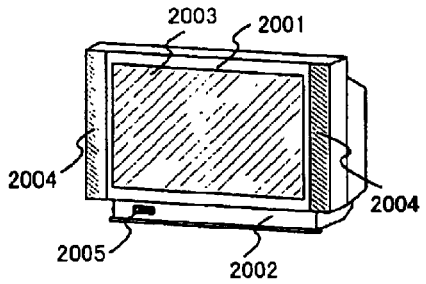
FIGS. 17A to 17H show electronic equipment using the light emitting device of the present invention.

FIG. 17A illustrates an organic light emitting display device which includes a casing 2001, a support table 2002, a display portion 2003, a speaker portion 2004, a video input terminal 2005 or the like. The present invention is applicable to the display portion 2003. The light emitting device is of the self-emission type and therefore requires no back light. Thus, the display portion thereof can have a thickness thinner than that of the liquid crystal display device. The organic light emitting display device is including all of the display device for displaying information, such as a personal computer, a receiver of TV broadcasting and an advertising display.

Figure 17B:
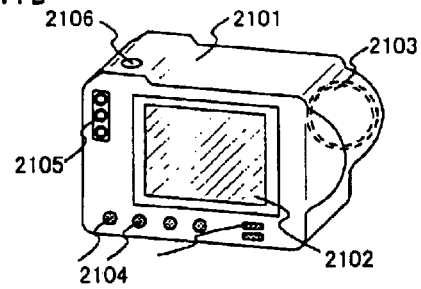

FIG. 17B illustrated a digital still camera which includes a main body 2101, a display portion 2102, an image receiving portion 2103, an operation key 2104, an external connection port 2105, a shutter 2106, or the like. The light emitting device in accordance with the present invention can be used as the display portion 2102.

Figure 17C:
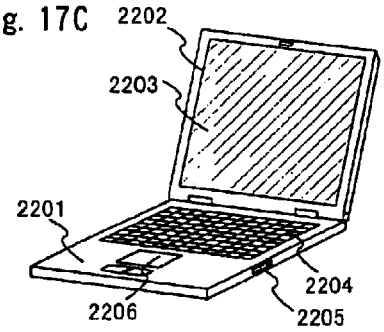

FIG. 17C illustrates a laptop computer which includes a main body 2201, a casing 2202, a display portion 2203, a keyboard 2204, an external connection port 2205, a pointing mouse 2206, or the like. The light emitting device in accordance with the present invention can be used as the display portion 2203.

Figure 17D:
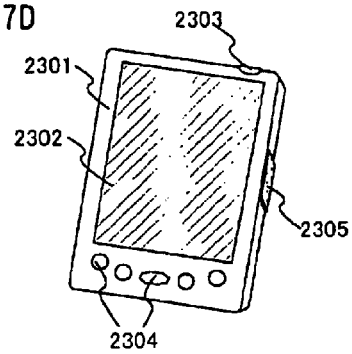

FIG. 17D illustrated a mobile computer which includes a main body 2301, a display portion 2302, a switch 2303, an operation key 2304, an infrared port 2305, or the like. The light emitting device in accordance with the present invention can be used as the display portion 2302.

Figure 17E:
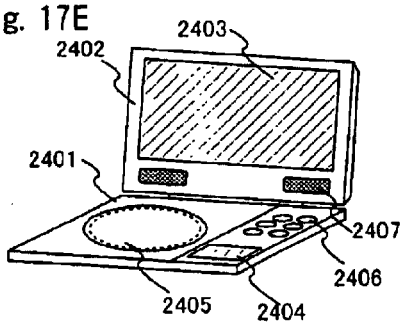

FIG. 17E illustrates an image reproduction apparatus including a recording medium (more specifically, a DVD reproduction apparatus), which includes a main body 2401, a casing 2402, a display portion A 2403, another display portion B 2404, a recording medium (DVD or the like) reading portion 2405, an operation key 2406, a speaker portion 2407 or the like. The display portion A 2403 is used mainly for displaying image information, while the display portion B 2404 is used mainly for displaying character information. The light emitting device in accordance with the present invention can be used as these display portions A and B. The image reproduction apparatus including a recording medium further includes a game machine or the like.

Figure 17F:
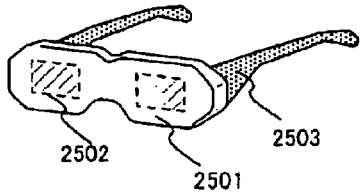

FIG. 17F illustrates a goggle type display (head mounted display) which includes a main body 2501, a display portion 2502, an arm portion 2503. The light emitting device in accordance with the present invention can be used as the display portion 2502.

Figure 17G:
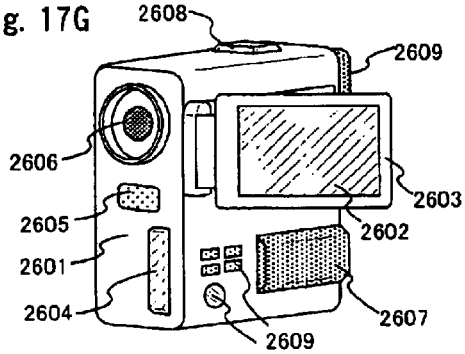

FIG. 17G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, or the like. The light emitting device in accordance with the present invention can be used as the display portion 2602.

Figure 17H:
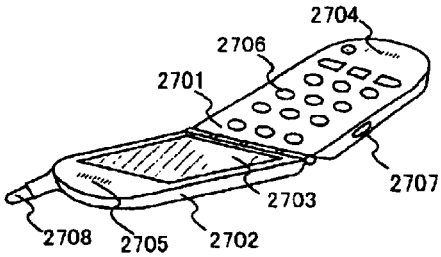
Figure 18A:
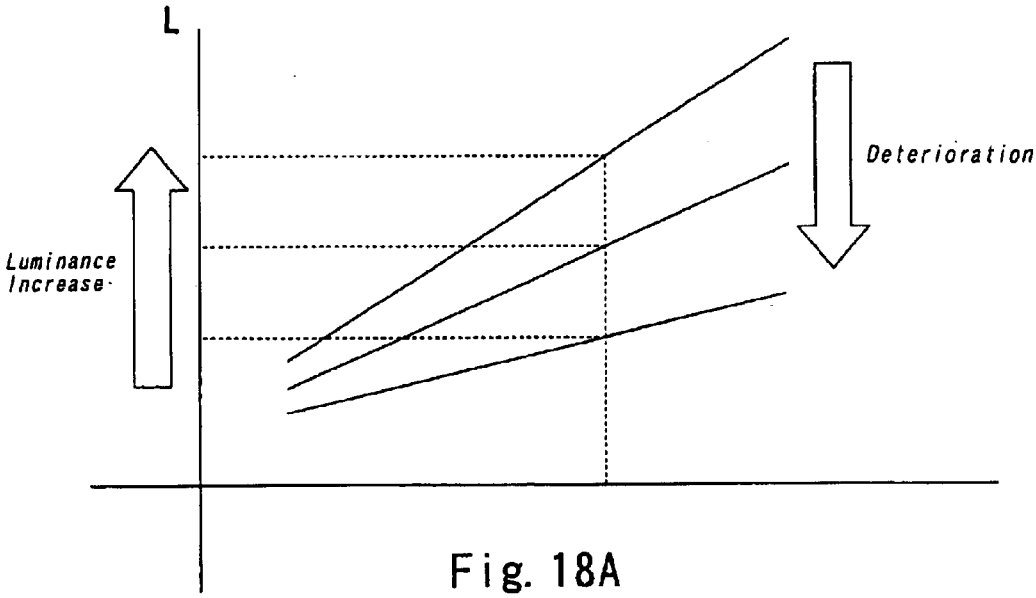
Figure 18B:
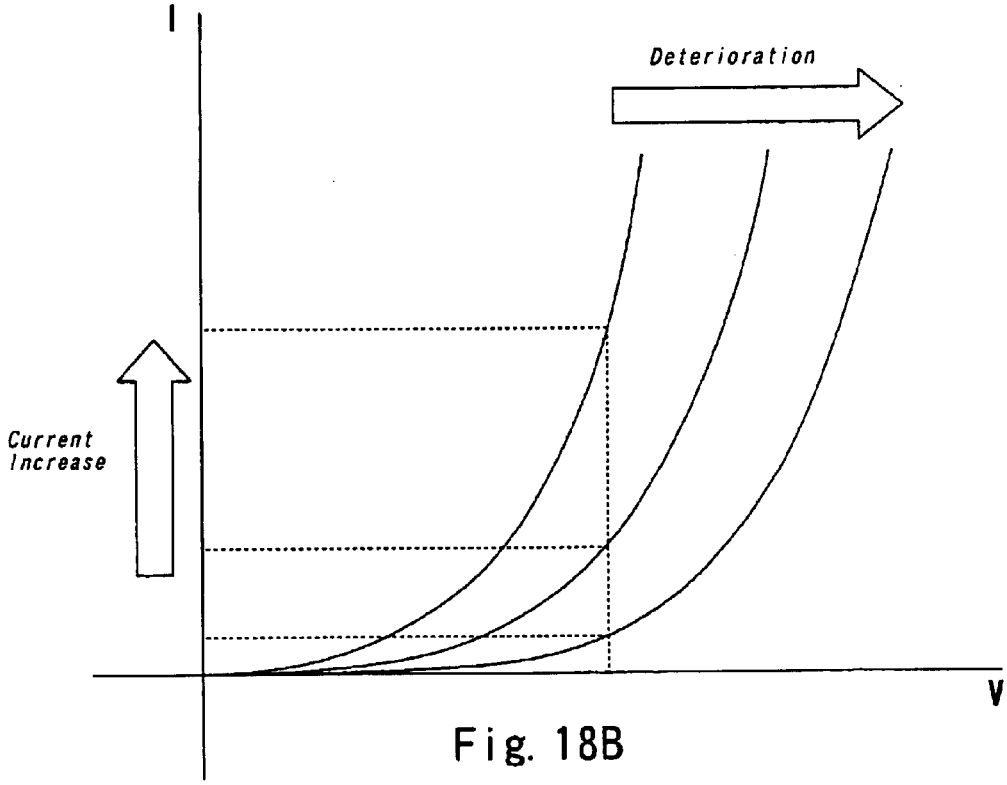

FIG. 17H illustrates a mobile phone which includes a main body 2701, a casing 2702, a display portion 2703, a sound input portion 2704, a sound output portion 2705, an operation key 2706, an external connecting port 2707, an antenna 2708, or the like. The light emitting device in accordance with the present invention can be used as the display portion 2703. Note that the display portion 2703 can reduce power consumption of the portable telephone by displaying white-colored characters on a black-colored background.

When the brighter luminance of light emitted from the organic light emitting material becomes available in the future, the light emitting device in accordance with the present invention will be applicable to a front-type or rear-type projector in which light including output image information is enlarged by means of lenses or the like to be projected.

The aforementioned electronic devices are more likely to be used for display information distributed through a telecommunication path such as Internet, a CATV (cable television system), and in particular likely to display moving picture information. The light emitting device is suitable for displaying moving pictures since the organic light emitting material can exhibit high response speed.

A portion of the light emitting device that is emitting light consumes power, so it is desirable to display information in such a manner that the light emitting portion therein becomes as small as possible. Accordingly, when the light emitting device is applied to a display portion which mainly displays character information, e.g., a display portion of a portable information terminal, and more particular, a portable telephone or a sound reproduction device, it is desirable to drive the light emitting device so that the character information is formed by a light emitting portion while a non-emission portion corresponds to the background.

As set forth above, the present invention can be applied variously to a wide range of electronic devices in all fields. The electronic device in this embodiment can be obtained by utilizing a light emitting device having the configuration in which the structures in Embodiments 1 through 10 are freely combined.

According to the present invention, the reduction of the luminance of the OLED is suppressed even if the organic light emitting layer is deteriorated with the structure easily used in practical use, as a result of which a clear image can be displayed. Further, in case of the light emitting device with the color display in which the OLEDs corresponding to respective colors are used, the balance of the luminance among the respective colors is prevented from being lost, and a desired color can be kept being displayed even if the organic light emitting layers of the OLEDs deteriorate at different speeds in accordance with the corresponding colors.

Further, the change of the luminance of the OLED can be suppressed even if the temperature of the organic light emitting layer is influenced by the outer temperature. the heat generated by the OLED panel itself, or the like. Also, the increase in power consumption with the temperature rise can be prevented. Further, in case of the light emitting device with the color display, the change of the luminance of the OLED of each color can be suppressed without being influenced by the temperature change. Thus, the balance of the luminance among the respective colors is prevented from being lost, and a desired color can be displayed.

What is claimed is:

1. A light emitting device comprising:

a first pixel portion having a first OLED;

a second pixel portion having a second OLED;

first means for measuring a current flowing in the second OLED;

second means for comparing the measured current value and a reference current value; and third means for correcting a voltage applied to the second OLED for making the value of the current flowing in the second OLED close to the reference current value based on a difference between the measured current value and the reference current value, wherein the first pixel portion is input with a display video signal, wherein the second pixel portion is input with a monitor video signal which is distinct from the display video signal, and wherein a voltage applied to the first OLED is kept at the same level as the voltage applied to the second OLED.

2. A light emitting device comprising:

a first pixel portion provided with a plurality of first pixels each having a first OLED;

a second pixel portion provided with a plurality of second pixels each having a second OLED;

first means for measuring the total of a current flowing in all the second OLEDs;

second means for comparing the measured current value and a reference current value; and third means for correcting a voltage applied to all the second OLEDs for making the value of the total of the current flowing to all the second OLEDs close to the reference current value based on a difference between the measured current value and the reference current value, wherein the first pixel portion is input with a display video signal.

wherein the second pixel portion is input with a monitor video signal which is distinct from the display video signal, and wherein a voltage applied to the first OLED is kept at the same level as the voltage applied to the second OLED.

3. A light emitting device comprising:

a first pixel portion provided with a plurality of first pixels each having a first OLED;

a second pixel portion provided with a plurality of second pixels each having a second OLED;

first means for measuring the total of a current flowing in all the second OLEDs;

second means for comparing the measured current value and a reference current value; and third means for correcting a voltage applied to all the second OLEDs for making the value of the total of the current flowing in all the second OLEDs close to the reference current value based on a difference between the measured current value and the reference current value, wherein the first pixel portion is input with a display video signal, wherein the second pixel portion is input with a monitor video signal which is distinct from the display video signal, wherein a voltage applied to the first OLED is kept at the same level as the voltage applied to the second OLED, and wherein the voltage to be corrected is changed with a constant size every time when the difference between the measured current value and the reference current value is changed with a constant width.

4. A light emitting device comprising:

a first pixel portion provided with a plurality of first pixels each having a first OLED;

a second pixel portion provided with a plurality of second pixels each having a second OLED;

first means for measuring the total of a current flowing in all the second OLEDs;

second means for comparing the measured current value and a reference current value; and third means for correcting a voltage applied to all the second OLEDs for making the value of the total of the current flowing in all the second OLEDs close to the reference current value based on a difference between the measured current value and the reference current value, wherein the first pixel portion is input with a display video signal, wherein the second pixel portion is input with a monitor video signal which is distinct from the display video signal, wherein a voltage applied to the first OLED is kept at the same level as the voltage applied to the second OLED, and wherein a specific image is displayed on the second pixel portion when the total of the current flowing in all the second OLEDs is measured.

5. A light emitting device comprising:

a first pixel portion provided with a plurality of first pixels each having a first OLED;

a second pixel portion provided with a plurality of second pixels each having a second OLED;

first means for measuring the total of a current flowing in all the second OLEDs;

second means for comparing the measured current value and a reference current value; and third means for correcting a voltage applied to all the second OLEDs for making the value of the total of the current flowing in all the second OLEDs close to the reference current value based on a difference between the measured current value and the reference current value, wherein the first pixel portion is input with a display video signa,.

wherein the second pixel portion is input with a monitor video signal which is distinct from the display video signal, wherein a voltage applied to the first OLED is kept at the same level as the voltage applied to the second OLED, and wherein the reference current value differs depending on an image displayed on the second pixel portion when the total of the current flowing in all the second OLEDs is measured.

6. A light emitting device comprising:

a first pixel portion provided with a plurality of first pixels each having a first OLED and at least one first TFT, the first TFT controlling light emission of the first OLED;

a second pixel portion provided with a plurality of second pixels each having a second OLED and at least one second TFT, the second TFT controlling light emission of the second OLED;

first means for measuring the total of a current flowing in all the second OLEDs;

second means for comparing the measured current value and a reference current value; and third means for correcting a voltage applied to all the second OLEDs for making the value of the total of the current flowing in all the second OLEDs close to the reference current value based on a difference between the measured current value and the reference current value, wherein the first pixel portion is input with a display video signal, wherein the second pixel portion is input with a monitor video signal which is distinct from the display video signal, and wherein a voltage applied to the first OLED is kept at the same level as the voltage applied to the second OLED.

7. A light emitting device according to any one of claims 1 to 6, wherein the first, second or third means are provided for each of corresponding colors of the first and second OLEDs.

8. A light emitting device comprising:

a display pixel portion having a first OLED;

a monitor pixel portion having a second OLED;

a variable power supply;

an ammeter for measuring a current flowing in the second OLED; and a correction circuit for comparing the measured current value and a reference current value and correcting a voltage applied to the second OLED for making the value of the current flowing in the second OLED close to the reference current value by controlling the variable power supply, wherein the display pixel portion is input with a display video signal, wherein the monitor pixel portion is input with a monitor video signal which is distinct from the display video signal, and wherein a voltage applied to the first OLED is kept at the same level as the voltage applied to the second OLED.

9. A light emitting device comprising:

a display pixel portion having a plurality of first OLEDs;

a monitor pixel portion having a plurality of second OLEDs;

an ammeter for measuring the total of a current flowing in all the plurality of second OLEDs; and a correction circuit for comparing the measured current value and a reference current value and correcting a voltage applied to all the plurality of second OLEDs for making the value of the total of the current flowing in all the plurality of second OLEDs close to the reference current value by controlling a variable power supply, wherein the display pixel portion is input with a display video signal, wherein the monitor pixel portion is input with a monitor video signal which is distinct from the display video signal, and wherein a voltage applied to the plurality of first OLEDs is kept at the same level as the voltage applied to the plurality of second OLEDs.

10. A light emitting device according to claim 8 or claim 9, wherein the variable power supply, the ammeter and the correction circuit are provided for each of corresponding colors of the first and second OLEDs.

11. A light emitting device comprising:

a first OLED;

a second OLED;

a first variable power supply;

a second variable power supply;

an ammeter for measuring a current flowing in the second OLED; and a correction circuit for comparing the measured current value and a reference current value and correcting a voltage applied to the second OLED for making the value of the current flowing in the second OLED close to the reference current value by controlling the second variable power supply, wherein a voltage applied to the first OLED is kept at the same level as the voltage applied to the second OLED by the first variable power supply.

12. A light emitting device according to any one of claims 8, 9 and 11, wherein a second substrate on which the correction circuit and the ammeter are formed is attached onto a first substrate on which the first and second OLEDs are formed.

13. A light emitting device according to any one of claims 8, 9 and 11, wherein a second substrate on which the correction circuit and the ammeter are formed is attached onto a first substrate on which the first and second OLEDs are formed by a COG method.

14. A light emitting device according to any one of claims 8, 9 and 11, wherein a second substrate on which the correction circuit and the ammeter are formed is attached onto a first substrate on which the first and second OLEDs are formed by a wire bonding method.

15. A light emitting device comprising:

a plurality of first OLEDs;

a plurality of second OLEDs;

an ammeter for measuring the total of a current flowing in all the plurality of second OLEDs; and a correction circuit for comparing the measured current value and a reference current value and correcting a voltage applied to all the plurality of second OLEDs for making the value of the total of the current flowing in all the plurality of second OLEDs close to the reference current value by controlling a variable power supply, wherein a voltage applied to the plurality of first OLEDs is kept at the same level as the voltage applied to the plurality of second OLEDs, and wherein the voltage to be corrected is changed with a constant size every time when the difference between the measured current value and the reference current value is changed with a constant width.

16. A light emitting device comprising:

a first pixel portion having a plurality of first OLEDs;

a second pixel portion having a plurality of second OLEDs;

an ammeter for measuring the total of a current flowing in all the plurality of second OLEDs; and a correction circuit for comparing the measured current value and a reference current value and correcting a voltage applied to all the plurality of second OLEDs for making the value of the total of the current flowing in all the plurality of second OLEDs close to the reference current value by controlling a variable power supply, wherein a voltage applied to the plurality of first OLEDs is kept at the same level as the voltage applied to the plurality of second OLEDs, and wherein a specific image is displayed on the second pixel portion when the total of the current flowing in all the plurality of second OLEDs is measured.

17. A light emitting device comprising:

a first pixel portion having a plurality of first OLEDs;

a second pixel portion having a plurality of second OLEDs;

an ammeter for measuring the total of a current flowing in all the plurality of second OLEDs; and a correction circuit for comparing the measured current value and a reference current value and correcting a voltage applied to all the plurality of second OLEDs for making the value of the total of the current flowing in all the plurality of second OLEDs close to the reference current value by controlling a variable power supply, wherein a voltage applied to the plurality of first OLEDs is kept at the same level as the voltage applied to the plurality of second OLEDs, and wherein the reference current value differs depending on an image displayed on the second pixel portion when the total of the current flowing in all the plurality of second OLEDs is measured.

18. A light emitting device according to any one of claims 15 to 17, wherein the variable power supply, the ammeter, and the correction circuit are provided for each of corresponding colors of the plurality of first OLEDs and the plurality of second OLEDs.

19. A light emitting device according to any one of claims 8, 9, 11 and 15 to 17, wherein a second substrate on which the correction circuit and the ammeter are formed is attached onto a first substrate on which the plurality of first OLEDs and the plurality of second OLEDs are formed.

20. A light emitting device according to any one of claims 8, 9, 11 and 15 to 17, wherein a second substrate on which the correction circuit and the ammeter are formed is attached onto a first substrate on which the plurality of first OLEDs and the plurality of second OLEDs are formed by a COG method.

21. A light emitting device according to any one of claims 8, 9, 11 and 15 to 17, wherein a second substrate on which the correction circuit and the ammeter are formed is attached onto a first substrate on which the plurality of first OLEDs and the plurality of second OLEDs are formed by a wire bonding method.

22. A light emitting device comprising:

a first pixel portion having a first OLED;

a second pixel portion having a second OLED;

first means for measuring a current flowing in the second OLED;

second means for comparing the measured current value and a reference current value; and third means for correcting a voltage applied to the first and second OLEDs based on a difference between the measured current value and the reference current value, wherein the first pixel portion is input with a display video signal, and wherein the second pixel portion is input with a monitor video signal which is distinct from the display video signal.

23. A light emitting device comprising:

a first OLED;

a second OLED;

a variable power supply;

an ammeter for measuring a current flowing in the second OLED; and a correction circuit for comparing the measured current value and a reference current value and correcting a voltage applied to the first and second OLEDs.

24. A light emitting device according to any one of claims 1 to 6, 8, 9, 11, 15 to 17, 22 and 23 wherein a period during which the first OLED and the second OLED emit light is controlled with a digital video signal to display gradations.

25. A light emitting device according to any one of claims 1 to 6, 8, 9, 11, 15 to 17, 22 and 23 wherein the light emitting device is incorporated into an electronic device selected from the group consisting of a video camera, a digital camera, a goggles-type display, a navigation system, a sound reproduction device, note-size personal computer, a game machine, a portable information terminal, and an image reproduction apparatus including a recording medium.

* * * * *